US010357429B2

(12) United States Patent
David et al.

(10) Patent No.: US 10,357,429 B2
(45) Date of Patent: Jul. 23, 2019

(54) LIQUID DRUG TRANSFER DEVICES FOR SECURE TELESCOPIC SNAP FIT ON INJECTION VIALS

(71) Applicant: MEDIMOP Medical Projects Ltd., Ra'anana (IL)

(72) Inventors: Uri David, Nes Ziona (IL); Igor Denenburg, Gedera (IL)

(73) Assignee: West Pharma. Services IL, Ltd., Ra'anana (IL)

( * ) Notice: Subject to any disclaimer, the term of this patent is extended or adjusted under 35 U.S.C. 154(b) by 0 days.

(21) Appl. No.: 15/741,548

(22) PCT Filed: Jul. 1, 2016

(86) PCT No.: PCT/IL2016/050709
§ 371 (c)(1),
(2) Date: Jan. 3, 2018

(87) PCT Pub. No.: WO2017/009822
PCT Pub. Date: Jan. 19, 2017

(65) Prior Publication Data

US 2018/0193228 A1 Jul. 12, 2018

(30) Foreign Application Priority Data

Jul. 16, 2015 (IL) ..... 240005

(51) Int. Cl.
*A61J 1/20* (2006.01)

(52) U.S. Cl.
CPC ..... *A61J 1/2096* (2013.01); *A61J 1/201* (2015.05); *A61J 1/2055* (2015.05); *A61J 1/2065* (2015.05)

(58) Field of Classification Search
CPC ..... A61J 1/2096; A61J 1/201; A61J 1/2055; A61J 1/2065
See application file for complete search history.

(56) References Cited

U.S. PATENT DOCUMENTS 62,333 A 2/1867 Holl
247,975 A 10/1881 Wickles
(Continued)

FOREIGN PATENT DOCUMENTS

CN 1636605 A 7/2005
CN 1747683 A 3/2006
(Continued)

OTHER PUBLICATIONS

Grifols Vial Adapter Product Literature, 2 pages, Jan. 2002.
(Continued)

*Primary Examiner* — Ariana Zimbouski
(74) *Attorney, Agent, or Firm* — Panitch Schwarze Belisario & Nadel LLP

(57) ABSTRACT

A liquid drug transfer device that includes a vial adapter having at least two non-adjacent vial retention flex members and at least two non-adjacent vial guidance flex members. The vial guidance flex members are each provisioned with a purpose design hinged zone distanced from a vial adapter top wall for intentionally being hinged thereat on telescopic snap fitting on an injection vial. The vial retention flex members can double as vial guidance flex members with the condition that their hinged zones are distal to their inwardly protruding vial retention ribs relative to the vial adapter top wall.

6 Claims, 9 Drawing Sheets

(56) References Cited

U.S. PATENT DOCUMENTS

| | | | |
|---|---|---|---|
| 254,444 | A | 2/1882 | Vogel |
| 300,060 | A | 6/1884 | Ford |
| 1,021,681 | A | 3/1912 | Jennings |
| 1,704,817 | A | 3/1929 | Ayers |
| 1,930,944 | A | 10/1933 | Schmitz, Jr. |
| 2,326,490 | A | 8/1943 | Perelson |
| 2,560,162 | A | 7/1951 | Garwood |
| 2,748,769 | A | 6/1956 | Huber |
| 2,830,587 | A | 4/1958 | Everett |
| 2,931,668 | A | 4/1960 | Baley |
| 2,968,497 | A | 1/1961 | Treleman |
| 3,059,643 | A | 10/1962 | Barton |
| D198,499 | S | 6/1964 | Harautuneian |
| 3,225,763 | A | 12/1965 | Waterman |
| 3,277,893 | A | 10/1966 | Clark |
| 3,308,822 | A | 3/1967 | De Luca |
| 3,484,849 | A | 12/1969 | Huebner et al. |
| 3,618,637 | A | 11/1971 | Santomieri |
| 3,757,981 | A | 9/1973 | Harris, Sr. et al. |
| 3,782,365 | A | 1/1974 | Pinna |
| 3,788,524 | A | 1/1974 | Davis et al. |
| 3,822,700 | A | 7/1974 | Pennington |
| 3,826,261 | A | 7/1974 | Killinger |
| 3,872,992 | A | 3/1975 | Larson |
| 3,885,607 | A | 5/1975 | Peltier |
| 3,938,520 | A | 2/1976 | Scislowicz et al. |
| 3,957,052 | A | 5/1976 | Topham |
| 3,977,555 | A | 8/1976 | Larson |
| 3,993,063 | A | 11/1976 | Larrabee |
| 4,020,839 | A | 5/1977 | Klapp |
| 4,026,128 | A | 5/1977 | Blanco |
| 4,051,852 | A | 10/1977 | Villari |
| D247,975 | S | 5/1978 | Luther |
| D248,568 | S | 7/1978 | Ismach |
| 4,109,670 | A | 8/1978 | Slagel |
| 4,121,585 | A | 10/1978 | Becker, Jr. |
| 4,161,178 | A | 7/1979 | Genese |
| 4,187,848 | A | 2/1980 | Taylor |
| D254,444 | S | 3/1980 | Levine |
| 4,203,067 | A | 5/1980 | Fitzky et al. |
| 4,203,443 | A | 5/1980 | Genese |
| 4,210,173 | A | 7/1980 | Choksi et al. |
| D257,286 | S | 10/1980 | Folkman |
| 4,253,501 | A | 3/1981 | Ogle |
| 4,296,786 | A | 10/1981 | Brignola |
| 4,303,067 | A | 12/1981 | Connolly et al. |
| 4,312,349 | A | 1/1982 | Cohen |
| 4,314,586 | A | 2/1982 | Folkman |
| 4,328,802 | A | 5/1982 | Curley et al. |
| 4,335,717 | A | 6/1982 | Bujan et al. |
| D267,199 | S | 12/1982 | Koenig |
| 4,376,634 | A | 3/1983 | Prior et al. |
| D268,871 | S | 5/1983 | Benham et al. |
| 4,392,850 | A | 7/1983 | Elias et al. |
| D270,282 | S | 8/1983 | Gross |
| 4,410,321 | A | 10/1983 | Pearson et al. |
| 4,411,662 | A | 10/1983 | Pearson |
| D271,421 | S | 11/1983 | Fetterman |
| 4,434,823 | A | 3/1984 | Hudspith |
| 4,465,471 | A | 8/1984 | Harris et al. |
| 4,475,915 | A | 10/1984 | Sloane |
| 4,493,348 | A | 1/1985 | Lemmons |
| 4,505,709 | A | 3/1985 | Froning et al. |
| 4,507,113 | A | 3/1985 | Dunlap |
| D280,018 | S | 8/1985 | Scott |
| 4,532,969 | A | 8/1985 | Kwaan |
| 4,564,054 | A | 1/1986 | Gustaysson |
| 4,573,993 | A | 3/1986 | Hoag et al. |
| 4,576,211 | A | 3/1986 | Valentini et al. |
| 4,581,014 | A | 4/1986 | Millerd et al. |
| 4,585,446 | A | 4/1986 | Kempf |
| 4,588,396 | A | 5/1986 | Stroebel et al. |
| 4,588,403 | A | 5/1986 | Weiss et al. |
| D284,603 | S | 7/1986 | Loignon |
| 4,604,093 | A | 8/1986 | Brown et al. |
| 4,607,671 | A | 8/1986 | Aalto et al. |
| 4,614,437 | A | 9/1986 | Buehler |
| 4,638,975 | A | 1/1987 | Iuchi et al. |
| 4,639,019 | A | 1/1987 | Mittleman |
| 4,667,927 | A | 5/1987 | Oscarsson |
| 4,675,020 | A | 6/1987 | McPhee |
| 4,676,530 | A | 6/1987 | Nordgren et al. |
| 4,683,975 | A | 8/1987 | Booth et al. |
| 4,697,622 | A | 10/1987 | Swift et al. |
| 4,721,133 | A | 1/1988 | Sundblom |
| 4,729,401 | A | 3/1988 | Raines |
| 4,735,608 | A | 4/1988 | Sardam |
| 4,743,229 | A | 5/1988 | Chu |
| 4,743,243 | A | 5/1988 | Vaillancourt |
| 4,752,292 | A | 6/1988 | Lopez et al. |
| 4,758,235 | A | 7/1988 | Tu |
| 4,759,756 | A | 7/1988 | Forman et al. |
| 4,778,447 | A | 10/1988 | Velde et al. |
| 4,787,898 | A | 11/1988 | Raines |
| 4,797,898 | A | 1/1989 | Martinez |
| D300,060 | S | 2/1989 | Molgaard-Nielsen |
| 4,804,366 | A | 2/1989 | Zdeb |
| 4,826,492 | A | 5/1989 | Magasi |
| 4,832,690 | A | 5/1989 | Kuu |
| 4,834,152 | A | 5/1989 | Howson et al. |
| D303,013 | S | 8/1989 | Konopka |
| 4,857,062 | A | 8/1989 | Russell |
| 4,865,592 | A | 9/1989 | Rycroft |
| 4,871,463 | A | 10/1989 | Taylor et al. |
| 4,898,209 | A | 2/1990 | Zbed |
| 4,909,290 | A | 3/1990 | Coccia |
| 4,919,596 | A | 4/1990 | Slate et al. |
| 4,927,423 | A | 5/1990 | Malmborg |
| 4,931,040 | A | 6/1990 | Haber et al. |
| 4,932,944 | A | 6/1990 | Jagger et al. |
| 4,967,797 | A | 11/1990 | Manska |
| D314,050 | S | 1/1991 | Sone |
| D314,622 | S | 2/1991 | Andersson et al. |
| 4,997,430 | A | 3/1991 | Van der Heiden et al. |
| 5,006,114 | A | 4/1991 | Rogers et al. |
| 5,035,686 | A | 7/1991 | Crittenden et al. |
| 5,041,105 | A | 8/1991 | D'Alo et al. |
| 5,045,066 | A | 9/1991 | Scheuble et al. |
| 5,049,129 | A | 9/1991 | Zdeb et al. |
| 5,053,015 | A | 10/1991 | Gross |
| 5,061,248 | A | 10/1991 | Sacco |
| 5,088,996 | A | 2/1992 | Kopfer et al. |
| 5,096,575 | A | 3/1992 | Cosack |
| 5,104,387 | A | 4/1992 | Pokorney et al. |
| 5,113,904 | A | 5/1992 | Aslanian |
| 5,122,124 | A | 6/1992 | Novacek et al. |
| 5,125,908 | A | 6/1992 | Cohen |
| 5,125,915 | A | 6/1992 | Berry et al. |
| D328,788 | S | 8/1992 | Sagae et al. |
| 5,171,230 | A | 12/1992 | Eland et al. |
| 5,201,705 | A | 4/1993 | Berglund et al. |
| 5,201,717 | A | 4/1993 | Wyatt et al. |
| 5,203,771 | A | 4/1993 | Melker et al. |
| 5,203,775 | A | 4/1993 | Frank et al. |
| 5,211,638 | A | 5/1993 | Dudar et al. |
| 5,232,029 | A | 8/1993 | Knox et al. |
| 5,232,109 | A | 8/1993 | Tirrell et al. |
| 5,242,432 | A | 9/1993 | DeFrank |
| 5,247,972 | A | 9/1993 | Tetreault |
| D341,420 | S | 11/1993 | Conn |
| 5,269,768 | A | 12/1993 | Cheung |
| 5,270,219 | A | 12/1993 | DeCastro et al. |
| 5,279,576 | A | 1/1994 | Loo et al. |
| 5,288,290 | A | 2/1994 | Brody |
| 5,300,034 | A | 4/1994 | Behnke et al. |
| 5,301,685 | A | 4/1994 | Guirguis |
| 5,304,163 | A | 4/1994 | Bonnici et al. |
| 5,304,165 | A | 4/1994 | Haber et al. |
| 5,308,483 | A | 5/1994 | Sklar et al. |
| 5,312,377 | A | 5/1994 | Dalton |
| 5,328,474 | A | 7/1994 | Raines |
| D349,648 | S | 8/1994 | Tirrell et al. |
| 5,334,163 | A | 8/1994 | Sinnett |
| 5,334,179 | A | 8/1994 | Poli et al. |

(56) References Cited

U.S. PATENT DOCUMENTS 5,342,346 A 8/1994 Honda et al.
5,344,417 A 9/1994 Wadsworth, Jr.
5,348,544 A 9/1994 Sweeney et al.
5,348,548 A 9/1994 Meyer et al.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
D357,733 S 4/1995 Matkovich
5,429,614 A 7/1995 Fowles et al.
5,433,330 A 7/1995 Yatsko et al.
5,445,630 A 8/1995 Richmond
5,445,631 A 8/1995 Uchida
D362,718 S 9/1995 Deily et al.
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,472,022 A 12/1995 Michel et al.
5,478,337 A 12/1995 Okamoto et al.
5,482,446 A 1/1996 Williamson et al.
5,492,147 A 2/1996 Challender et al.
5,496,274 A 3/1996 Graves et al.
D369,406 S 4/1996 Niedospial et al.
5,505,714 A 4/1996 Dassa et al.
5,509,433 A 4/1996 Paradis
5,515,871 A 5/1996 Bittner et al.
5,520,659 A 5/1996 Hedges
5,526,853 A 6/1996 McPhee et al.
5,527,306 A 6/1996 Haining
5,531,695 A 7/1996 Swisher
5,547,471 A 8/1996 Thompson et al.
5,549,577 A 8/1996 Siegel et al.
5,554,128 A 9/1996 Hedges
5,562,686 A 10/1996 Sauer et al.
5,562,696 A 10/1996 Nobles et al.
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,637,101 A 6/1997 Shillington
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,658,133 A 8/1997 Anderson et al.
5,672,160 A 9/1997 Osterlind et al.
5,674,195 A 10/1997 Truthan
5,676,346 A 10/1997 Leinsing
5,685,845 A 11/1997 Grimard
D388,172 S 12/1997 Cipes
5,699,821 A 12/1997 Paradis
5,702,019 A 12/1997 Grimard
5,718,346 A 2/1998 Weiler
5,728,087 A 3/1998 Niedospial, Jr.
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,752,942 A 5/1998 Doyle et al.
5,755,696 A 5/1998 Caizza
5,766,211 A 6/1998 Wood et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,810,792 A 9/1998 Fangrow, Jr. et al.
5,814,020 A 9/1998 Gross
D399,559 S 10/1998 Molina
5,817,082 A 10/1998 Niedospial, Jr. et al.
5,820,621 A 10/1998 Yale et al.
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
D405,522 S 2/1999 Hoenig et al.
5,868,710 A 2/1999 Battiato et al.
5,871,110 A 2/1999 Grimard et al.
5,873,872 A 2/1999 Thibault et al.
5,879,337 A 3/1999 Kuracina et al.
5,879,345 A 3/1999 Aneas
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr. et al.
D410,740 S 6/1999 Molina
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.
5,941,850 A 8/1999 Shah et al.
5,944,700 A 8/1999 Nguyen et al.
5,954,104 A 9/1999 Daubert et al.
5,968,022 A 10/1999 Saito
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
D427,309 S 6/2000 Molina
6,070,623 A 6/2000 Aneas
6,071,270 A 6/2000 Fowles et al.
6,080,132 A 6/2000 Cole et al.
D428,141 S 7/2000 Brotspies et al.
6,086,762 A 7/2000 Guala
6,089,541 A 7/2000 Weinheimer et al.
6,090,091 A 7/2000 Fowles et al.
6,090,093 A 7/2000 Thibault et al.
6,092,692 A 7/2000 Riskin
D430,291 S 8/2000 Jansen et al.
6,099,511 A 8/2000 Devos et al.
6,113,068 A 9/2000 Ryan
6,113,583 A 9/2000 Fowles et al.
6,117,114 A 9/2000 Paradis
D431,864 S 10/2000 Jansen
6,139,534 A 10/2000 Niedospial, Jr. et al.
6,142,446 A 11/2000 Leinsing
6,146,362 A 11/2000 Turnbull et al.
6,149,623 A 11/2000 Reynolds
6,156,025 A 12/2000 Niedospial, Jr. et al.

(56) References Cited

U.S. PATENT DOCUMENTS 6,159,192 A 12/2000 Fowles et al.
6,168,037 B1 1/2001 Grimard
6,171,287 B1 1/2001 Lynn et al.
6,171,293 B1 1/2001 Rowley et al.
6,173,852 B1 1/2001 Browne
6,173,868 B1 1/2001 DeJonge
6,174,304 B1 1/2001 Weston
6,179,822 B1 1/2001 Niedospial, Jr.
6,179,823 B1 1/2001 Niedospial, Jr.
6,206,861 B1 3/2001 Mayer
6,221,041 B1 4/2001 Russo
6,221,054 B1 4/2001 Martin et al.
6,221,065 B1 4/2001 Davis
6,238,372 B1 5/2001 Zinger et al.
6,245,044 B1 6/2001 Daw et al.
D445,501 S 7/2001 Niedospial, Jr.
D445,895 S 7/2001 Svendsen
6,253,804 B1 7/2001 Safabash
6,258,078 B1 7/2001 Thilly
6,280,430 B1 8/2001 Neftel et al.
6,290,688 B1 9/2001 Lopez et al.
6,296,621 B1 10/2001 Masuda et al.
6,299,131 B1 10/2001 Ryan
6,343,629 B1 2/2002 Wessman et al.
6,348,044 B1 2/2002 Coletti et al.
6,358,236 B1 3/2002 DeFoggi et al.
6,364,866 B1 4/2002 Furr et al.
6,378,576 B2 4/2002 Thibault et al.
6,378,714 B1 4/2002 Jansen et al.
6,379,340 B1 4/2002 Zinger et al.
D457,954 S 5/2002 Wallace et al.
6,382,442 B1 5/2002 Thibault et al.
6,386,397 B2 5/2002 Brotspies et al.
6,408,897 B1 6/2002 Laurent et al.
6,409,708 B1 6/2002 Wessman
6,440,107 B1 8/2002 Trombley, III et al.
6,453,949 B1 9/2002 Chau
6,453,956 B2 9/2002 Safabash
6,474,375 B2 11/2002 Spero et al.
6,478,788 B1 11/2002 Aneas
D468,015 S 12/2002 Horppu
6,499,617 B1 12/2002 Niedospial, Jr. et al.
6,503,240 B1 1/2003 Niedospial, Jr. et al.
6,503,244 B2 1/2003 Hayman
6,520,932 B2 2/2003 Taylor
6,524,278 B1 2/2003 Campbell et al.
6,524,295 B2 2/2003 Daubert et al.
D472,316 S 3/2003 Douglas et al.
6,530,903 B2 3/2003 Wang et al.
6,537,263 B1 3/2003 Aneas
D472,630 S 4/2003 Douglas et al.
6,544,246 B1 4/2003 Niedospial, Jr.
6,551,299 B2 4/2003 Miyoshi et al.
6,558,365 B2 5/2003 Zinger et al.
6,571,837 B2 6/2003 Jansen et al.
6,572,591 B2 6/2003 Mayer
6,575,955 B2 6/2003 Azzolini
6,581,593 B1 6/2003 Rubin et al.
6,582,415 B1 6/2003 Fowles et al.
D476,731 S 7/2003 Cise et al.
6,591,876 B2 7/2003 Safabash
6,599,273 B1 7/2003 Lopez
6,601,721 B2 8/2003 Jansen et al.
6,626,309 B1 9/2003 Jansen et al.
6,632,201 B1 10/2003 Mathias et al.
6,638,244 B1 10/2003 Reynolds
D482,121 S 11/2003 Harding et al.
D482,447 S 11/2003 Harding et al.
6,651,956 B2 11/2003 Miller
6,652,509 B1 11/2003 Helgren et al.
D483,487 S 12/2003 Harding et al.
D483,869 S 12/2003 Tran et al.
6,656,433 B2 12/2003 Sasso
6,666,852 B2 12/2003 Niedospial, Jr.
6,681,810 B2 1/2004 Weston
6,681,946 B1 1/2004 Jansen et al.
6,682,509 B2 1/2004 Lopez
6,692,478 B1 2/2004 Paradis
6,692,829 B2 2/2004 Stubler et al.
6,695,829 B2 2/2004 Hellstrom et al.
6,699,229 B2 3/2004 Zinger et al.
6,706,022 B1 3/2004 Leinsing et al.
6,706,031 B2 3/2004 Manera
6,715,520 B2 4/2004 Andreasson et al.
6,729,370 B2 5/2004 Norton et al.
6,736,798 B2 5/2004 Ohkubo et al.
6,745,998 B2 6/2004 Doyle
6,746,438 B1 6/2004 Amissolle
6,752,180 B2 6/2004 Delay
D495,416 S 8/2004 Dimeo et al.
D496,457 S 9/2004 Prais et al.
6,802,490 B2 10/2004 Leinsing et al.
6,832,994 B2 12/2004 Niedospial, Jr. et al.
6,852,103 B2 2/2005 Fowles et al.
6,875,203 B1 4/2005 Fowles et al.
6,875,205 B2 4/2005 Leinsing
6,878,131 B2 4/2005 Novacek et al.
6,884,253 B1 4/2005 McFarlane
6,890,328 B2 5/2005 Fowles et al.
D506,256 S 6/2005 Miyoshi et al.
6,901,975 B2 6/2005 Aramata et al.
6,945,417 B2 9/2005 Jansen et al.
6,948,522 B2 9/2005 Newbrough et al.
6,949,086 B2 9/2005 Ferguson et al.
6,951,613 B2 10/2005 Reif et al.
6,957,745 B2 10/2005 Thibault et al.
6,960,164 B2 11/2005 O'Heeron
6,972,002 B2 12/2005 Thorne
6,979,318 B1 12/2005 McDonald et al.
RE38,996 E 2/2006 Crawford et al.
6,994,315 B2 2/2006 Ryan et al.
6,997,916 B2 2/2006 Simas, Jr. et al.
6,997,917 B2 2/2006 Niedospial, Jr. et al.
7,024,968 B2 4/2006 Raudabough et al.
7,070,589 B2 7/2006 Lolachi et al.
7,074,216 B2 7/2006 Fowles et al.
7,083,600 B2 8/2006 Meloul
7,086,431 B2 8/2006 D'Antonio et al.
7,097,637 B2 8/2006 Triplett et al.
7,100,890 B2 9/2006 Cote, Sr. et al.
7,140,401 B2 11/2006 Wilcox et al.
7,150,735 B2 12/2006 Hickle
7,192,423 B2 3/2007 Wong
7,195,623 B2 3/2007 Burroughs et al.
7,241,285 B1 7/2007 Dikeman
7,294,122 B2 11/2007 Kubo et al.
7,306,199 B2 12/2007 Leinsing et al.
D561,348 S 2/2008 Zinger et al.
7,326,188 B1 2/2008 Russell et al.
7,326,194 B2 2/2008 Zinger et al.
7,350,764 B2 4/2008 Raybuck
7,354,422 B2 4/2008 Riesenberger et al.
7,354,427 B2 4/2008 Fangrow
7,425,209 B2 9/2008 Fowles et al.
7,435,246 B2 10/2008 Zihlmann
D580,558 S 11/2008 Shigesada et al.
7,452,348 B2 11/2008 Hasegawa
7,470,257 B2 12/2008 Norton et al.
7,470,265 B2 12/2008 Brugger et al.
7,472,932 B2 1/2009 Weber et al.
7,488,297 B2 2/2009 Flaherty
7,491,197 B2 2/2009 Jansen et al.
7,497,848 B2 3/2009 Leinsing et al.
7,523,967 B2 4/2009 Steppe
7,530,546 B2 5/2009 Ryan et al.
D595,420 S 6/2009 Suzuki et al.
D595,421 S 6/2009 Suzuki et al.
7,540,863 B2 6/2009 Haindl
7,540,865 B2 6/2009 Griffin et al.
7,544,191 B2 6/2009 Peluso et al.
D595,862 S 7/2009 Suzuki et al.
D595,863 S 7/2009 Suzuki et al.
7,611,487 B2 11/2009 Woehr et al.
7,611,502 B2 11/2009 Daly

(56) References Cited

U.S. PATENT DOCUMENTS 7,615,041 B2 11/2009 Sullivan et al.
7,628,779 B2 12/2009 Aneas
7,632,261 B2 12/2009 Zinger et al.
D608,900 S 1/2010 Giraud et al.
7,654,995 B2 2/2010 Warren et al.
7,670,326 B2 3/2010 Shemesh
7,695,445 B2 4/2010 Yuki
7,704,229 B2 4/2010 Moberg et al.
D616,090 S 5/2010 Kawamura
7,713,247 B2 5/2010 Lopez
7,717,886 B2 5/2010 Lopez
7,722,090 B2 5/2010 Burton et al.
D616,984 S 6/2010 Gilboa
7,731,678 B2 6/2010 Tennican et al.
7,743,799 B2 6/2010 Mosler et al.
7,744,581 B2 6/2010 Wallen et al.
7,757,901 B2 7/2010 Welp
7,758,082 B2 7/2010 Weigel et al.
7,758,560 B2 7/2010 Connell et al.
7,762,524 B2 7/2010 Cawthon et al.
7,766,304 B2 8/2010 Phillips
7,771,383 B2 8/2010 Truitt
D624,641 S 9/2010 Boclet
7,799,009 B2 9/2010 Niedospial, Jr. et al.
7,803,140 B2 9/2010 Fangrow, Jr.
D627,216 S 11/2010 Fulginiti
D630,732 S 1/2011 Lev et al.
7,862,537 B2 1/2011 Zinger et al.
7,867,215 B2 1/2011 Akerlund et al.
7,879,018 B2 2/2011 Zinger et al.
7,895,216 B2 2/2011 Longshaw et al.
D634,007 S 3/2011 Zinger et al.
7,900,659 B2 3/2011 Whitley et al.
D637,713 S 5/2011 Nord et al.
D641,080 S 7/2011 Zinger et al.
7,985,216 B2 7/2011 Daily et al.
D644,104 S 8/2011 Maeda et al.
7,993,328 B2 8/2011 Whitley
8,007,461 B2 8/2011 Huo et al.
8,012,132 B2 9/2011 Lum et al.
8,016,809 B2 9/2011 Zinger et al.
8,021,325 B2 9/2011 Zinger et al.
8,025,653 B2 9/2011 Capitaine et al.
8,025,683 B2 9/2011 Morrison
8,029,472 B2 10/2011 Leinsing et al.
8,038,123 B2 10/2011 Ruschke et al.
8,066,688 B2 11/2011 Zinger et al.
8,070,739 B2 * 12/2011 Zinger ..... A61J 1/2089 604/411
8,075,550 B2 12/2011 Nord et al.
8,096,525 B2 1/2012 Ryan
8,105,314 B2 1/2012 Fangrow, Jr.
D654,166 S 2/2012 Lair
D655,017 S 2/2012 Mosler et al.
8,122,923 B2 2/2012 Kraus et al.
8,123,736 B2 2/2012 Kraushaar et al.
D655,071 S 3/2012 Davila
D657,461 S 4/2012 Schembre et al.
8,152,779 B2 4/2012 Cabiri
8,157,784 B2 4/2012 Rogers
8,167,863 B2 5/2012 Yow
8,172,824 B2 5/2012 Pfeifer et al.
8,177,768 B2 5/2012 Leinsing
8,182,452 B2 5/2012 Mansour et al.
8,187,248 B2 5/2012 Zihlmann
8,196,614 B2 6/2012 Kriheli
8,197,459 B2 6/2012 Jansen et al.
8,211,069 B2 7/2012 Fangrow, Jr.
8,225,959 B2 7/2012 Lambrecht
8,241,268 B2 8/2012 Whitley
8,262,628 B2 9/2012 Fangrow, Jr.
8,262,641 B2 9/2012 Vedrine et al.
8,267,127 B2 9/2012 Kriheli
D669,980 S 10/2012 Lev et al.
8,287,513 B2 10/2012 Ellstrom et al.
8,328,784 B2 12/2012 Jensen et al.
D673,673 S 1/2013 Wang
D674,084 S 1/2013 Linnenschmidt
D674,088 S 1/2013 Lev et al.
8,348,898 B2 1/2013 Cabiri
D681,230 S 4/2013 Mosler et al.
8,454,573 B2 6/2013 Wyatt et al.
8,469,939 B2 6/2013 Fangrow, Jr.
8,475,404 B2 7/2013 Foshee et al.
8,480,645 B1 7/2013 Choudhury et al.
8,480,646 B2 7/2013 Nord et al.
8,506,548 B2 8/2013 Okiyama
8,511,352 B2 8/2013 Kraus et al.
8,512,309 B2 8/2013 Shemesh et al.
D690,009 S 9/2013 Schembre et al.
D690,418 S 9/2013 Rosenquist
8,523,837 B2 9/2013 Wiggins et al.
8,545,476 B2 10/2013 Ariagno et al.
8,551,067 B2 10/2013 Zinger et al.
8,556,879 B2 10/2013 Okiyama
8,562,582 B2 10/2013 Tuckwell et al.
8,608,723 B2 12/2013 Lev et al.
8,628,508 B2 1/2014 Weitzel et al.
8,684,992 B2 4/2014 Sullivan et al.
8,684,994 B2 4/2014 Lev et al.
8,752,598 B2 6/2014 Denenburg et al.
D714,935 S 10/2014 Nishioka et al.
D717,406 S 11/2014 Stanley et al.
D717,948 S 11/2014 Strong et al.
D719,650 S 12/2014 Arinobe et al.
D720,067 S 12/2014 Rosenquist
D720,451 S 12/2014 Denenburg et al.
D720,452 S 12/2014 Jordan
8,900,212 B2 12/2014 Kubo
8,905,994 B1 12/2014 Lev et al.
8,915,882 B2 12/2014 Cabiri
D720,850 S 1/2015 Hsia et al.
D732,660 S 6/2015 Ohashi
D732,664 S 6/2015 Woehr et al.
D733,291 S 6/2015 Wang
D733,292 S 6/2015 Rogers
D733,293 S 6/2015 Rogers
9,072,827 B2 7/2015 Cabiri
D738,494 S 9/2015 Kashmirian
D741,457 S 10/2015 Guest
9,149,575 B2 10/2015 Cabiri
D750,235 S 2/2016 Maurice
D757,933 S 5/2016 Lev et al.
9,393,365 B2 7/2016 Cabiri
9,486,391 B2 11/2016 Shemesh
9,492,610 B2 11/2016 Cabiri
9,511,190 B2 12/2016 Cabiri
9,522,234 B2 12/2016 Cabiri
D794,183 S 8/2017 Lev et al.
9,763,855 B2 9/2017 Fangrow
2001/0000347 A1 4/2001 Hellstrom et al.
2001/0025671 A1 10/2001 Safabash
2001/0029360 A1 10/2001 Miyoshi et al.
2001/0051793 A1 12/2001 Weston
2002/0017328 A1 2/2002 Loo
2002/0055711 A1 5/2002 Lavi et al.
2002/0065488 A1 5/2002 Suzuki et al.
2002/0066715 A1 6/2002 Niedospial
2002/0087118 A1 7/2002 Reynolds et al.
2002/0087141 A1 7/2002 Zinger et al.
2002/0087144 A1 7/2002 Zinger et al.
2002/0121496 A1 9/2002 Thiebault et al.
2002/0123736 A1 9/2002 Fowles et al.
2002/0127150 A1 9/2002 Sasso
2002/0128628 A1 9/2002 Fathallah
2002/0138045 A1 9/2002 Moen
2002/0173752 A1 11/2002 Polzin
2002/0193777 A1 12/2002 Aneas
2003/0028156 A1 2/2003 Juliar
2003/0036725 A1 2/2003 Lavi et al.
2003/0068354 A1 4/2003 Reif et al.
2003/0069550 A1 4/2003 Sharp
2003/0073971 A1 4/2003 Saker
2003/0100866 A1 5/2003 Reynolds

(56) References Cited

U.S. PATENT DOCUMENTS

2003/0109846 A1 6/2003 Zinger et al.
2003/0120209 A1 6/2003 Jensen et al.
2003/0135159 A1 7/2003 Daily et al.
2003/0153895 A1* 8/2003 Leinsing ..... A61J 1/2089 604/403
2003/0187420 A1 10/2003 Akerlund et al.
2003/0191445 A1 10/2003 Wallen et al.
2003/0195479 A1 10/2003 Kuracina et al.
2003/0199827 A1 10/2003 Thorne
2003/0199846 A1 10/2003 Fowles et al.
2003/0199847 A1 10/2003 Akerlund et al.
2003/0205843 A1 11/2003 Adams
2003/0236543 A1 12/2003 Brenneman et al.
2004/0010207 A1 1/2004 Flaherty et al.
2004/0024354 A1 2/2004 Reynolds
2004/0039365 A1 2/2004 Aramata et al.
2004/0044327 A1 3/2004 Hasegawa
2004/0073189 A1 4/2004 Wyatt et al.
2004/0143218 A1 7/2004 Das
2004/0143226 A1 7/2004 Marsden
2004/0153047 A1 8/2004 Blank et al.
2004/0158172 A1 8/2004 Hancock
2004/0162540 A1 8/2004 Walenciak et al.
2004/0167472 A1 8/2004 Howell et al.
2004/0181192 A1 9/2004 Cuppy
2004/0186424 A1 9/2004 Hjertman
2004/0199139 A1 10/2004 Fowles et al.
2004/0204699 A1 10/2004 Hanly et al.
2004/0217315 A1 11/2004 Doyle
2004/0225274 A1 11/2004 Jansen et al.
2004/0236305 A1 11/2004 Jansen et al.
2004/0249341 A1 12/2004 Newbrough et al.
2004/0255952 A1 12/2004 Carlsen et al.
2005/0015070 A1 1/2005 Delnevo et al.
2005/0016626 A1 1/2005 Wilcox et al.
2005/0049553 A1 3/2005 Triplett et al.
2005/0055008 A1 3/2005 Paradis et al.
2005/0082828 A1 4/2005 Wicks et al.
2005/0124964 A1 6/2005 Niedospial et al.
2005/0137523 A1 6/2005 Wyatt et al.
2005/0137566 A1 6/2005 Fowles et al.
2005/0148994 A1 7/2005 Leinsing
2005/0159706 A1 7/2005 Wilkinson et al.
2005/0159724 A1 7/2005 Enerson
2005/0182383 A1 8/2005 Wallen
2005/0209554 A1 9/2005 Landau
2005/0261637 A1 11/2005 Miller
2005/0277896 A1 12/2005 Messerli et al.
2006/0030832 A1 2/2006 Niedospial et al.
2006/0079834 A1 4/2006 Tennican et al.
2006/0089594 A1 4/2006 Landau
2006/0089603 A1 4/2006 Truitt et al.
2006/0095015 A1 5/2006 Hobbs et al.
2006/0106360 A1 5/2006 Wong
2006/0135948 A1 6/2006 Varma
2006/0155257 A1 7/2006 Reynolds
2006/0161192 A1 7/2006 Young
2006/0173410 A1 8/2006 Moberg et al.
2006/0178646 A1 8/2006 Harris et al.
2006/0195029 A1 8/2006 Shults et al.
2006/0212004 A1 9/2006 Atil
2006/0253084 A1 11/2006 Nordgren
2006/0259004 A1 11/2006 Connell et al.
2007/0016381 A1 1/2007 Kamath et al.
2007/0024995 A1 2/2007 Hayashi
2007/0060904 A1 3/2007 Vedrine et al.
2007/0078428 A1 4/2007 Reynolds et al.
2007/0079894 A1 4/2007 Kraus et al.
2007/0083164 A1 4/2007 Barrelle et al.
2007/0088252 A1 4/2007 Pestotnik et al.
2007/0088293 A1 4/2007 Fangrow
2007/0088313 A1 4/2007 Zinger et al.
2007/0106218 A1 5/2007 Yodfat et al.
2007/0106244 A1 5/2007 Mosler et al.
2007/0112324 A1 5/2007 Hamedi-Sangsari
2007/0156112 A1 7/2007 Walsh
2007/0167904 A1 7/2007 Zinger et al.
2007/0167912 A1 7/2007 Causey et al.
2007/0191760 A1 8/2007 Iguchi et al.
2007/0191764 A1 8/2007 Zihlmann
2007/0191767 A1 8/2007 Hennessy et al.
2007/0203451 A1 8/2007 Murakami et al.
2007/0219483 A1 9/2007 Kitani et al.
2007/0244447 A1 10/2007 Capitaine et al.
2007/0244461 A1 10/2007 Fangrow
2007/0244462 A1 10/2007 Fangrow
2007/0244463 A1 10/2007 Warren et al.
2007/0249995 A1 10/2007 Van Manen
2007/0255202 A1 11/2007 Kitani et al.
2007/0265574 A1 11/2007 Tennican et al.
2007/0265581 A1 11/2007 Funamura et al.
2007/0270778 A9 11/2007 Zinger et al.
2007/0287953 A1 12/2007 Ziv et al.
2007/0299404 A1 12/2007 Katoh et al.
2008/0009789 A1 1/2008 Zinger et al.
2008/0009822 A1 1/2008 Enerson
2008/0015496 A1 1/2008 Hamedi-Sangsari
2008/0135051 A1 6/2008 Lee
2008/0172024 A1 7/2008 Yow
2008/0188799 A1 8/2008 Mueller-Beckhaus et al.
2008/0195049 A1 8/2008 Thalmann et al.
2008/0208138 A1 8/2008 Lim et al.
2008/0215015 A1 9/2008 Cindrich et al.
2008/0249473 A1 10/2008 Ruth et al.
2008/0249479 A1 10/2008 Zinger et al.
2008/0249498 A1 10/2008 Fangrow
2008/0262465 A1 10/2008 Zinger et al.
2008/0269687 A1 10/2008 Chong et al.
2008/0275407 A1 11/2008 Scheurer
2008/0287905 A1 11/2008 Hiejima et al.
2008/0294100 A1 11/2008 de Costa et al.
2008/0306439 A1 12/2008 Nelson et al.
2008/0312634 A1 12/2008 Helmerson et al.
2009/0012492 A1 1/2009 Zihlmann
2009/0043253 A1 2/2009 Podaima
2009/0054834 A1 2/2009 Zinger et al.
2009/0054852 A1 2/2009 Takano et al.
2009/0062767 A1 3/2009 Van Antwerp et al.
2009/0076360 A1 3/2009 Brister et al.
2009/0082750 A1 3/2009 Denenburg et al.
2009/0139724 A1 6/2009 Gray et al.
2009/0143758 A1 6/2009 Okiyama
2009/0177177 A1 7/2009 Zinger et al.
2009/0177178 A1 7/2009 Pedersen
2009/0187140 A1 7/2009 Racz
2009/0216103 A1 8/2009 Brister et al.
2009/0216212 A1 8/2009 Fangrow, Jr.
2009/0267011 A1 10/2009 Hatton et al.
2009/0299325 A1 12/2009 Vedrine et al.
2009/0318946 A1 12/2009 Tamesada
2009/0326506 A1 12/2009 Hasegawa et al.
2010/0010443 A1 1/2010 Morgan et al.
2010/0016811 A1 1/2010 Smith
2010/0022985 A1 1/2010 Sullivan et al.
2010/0030181 A1 2/2010 Helle et al.
2010/0036319 A1 2/2010 Drake et al.
2010/0076397 A1 3/2010 Reed et al.
2010/0087786 A1 4/2010 Zinger et al.
2010/0137827 A1 6/2010 Warren et al.
2010/0137831 A1 6/2010 Tsals
2010/0152658 A1 6/2010 Hanson et al.
2010/0160889 A1 6/2010 Smith et al.
2010/0162548 A1 7/2010 Leidig
2010/0168664 A1 7/2010 Zinger et al.
2010/0168712 A1 7/2010 Tuckwell et al.
2010/0179506 A1 7/2010 Shemesh et al.
2010/0198148 A1 8/2010 Zinger et al.
2010/0204670 A1 8/2010 Kraushaar et al.
2010/0228220 A1 9/2010 Zinger et al.
2010/0241088 A1 9/2010 Ranalletta et al.
2010/0274184 A1 10/2010 Chun
2010/0274202 A1 10/2010 Hyde et al.
2010/0286661 A1 11/2010 Raday et al.
2010/0312220 A1 12/2010 Kalitzki

(56) References Cited

U.S. PATENT DOCUMENTS

| | | | |
|---|---|---|---|
| 2011/0004143 | A1 | 1/2011 | Beiriger et al. |
| 2011/0004184 | A1 | 1/2011 | Proksch et al. |
| 2011/0044850 | A1 | 2/2011 | Solomon et al. |
| 2011/0054440 | A1 | 3/2011 | Lewis |
| 2011/0087164 | A1 | 4/2011 | Mosler et al. |
| 2011/0125056 | A1 | 5/2011 | Merchant |
| 2011/0144584 | A1 | 6/2011 | Wozencroft |
| 2011/0160655 | A1 | 6/2011 | Hanson et al. |
| 2011/0160701 | A1 | 6/2011 | Wyatt et al. |
| 2011/0172636 | A1 | 7/2011 | Aasmul |
| 2011/0175347 | A1 | 7/2011 | Okiyama |
| 2011/0218511 | A1 | 9/2011 | Yokoyama |
| 2011/0224640 | A1 | 9/2011 | Kuhn et al. |
| 2011/0230856 | A1 | 9/2011 | Kyle et al. |
| 2011/0264037 | A1 | 10/2011 | Foshee et al. |
| 2011/0264069 | A1 | 10/2011 | Bochenko |
| 2011/0276007 | A1 | 11/2011 | Denenburg |
| 2011/0319827 | A1 | 12/2011 | Leinsing et al. |
| 2012/0022344 | A1 | 1/2012 | Kube |
| 2012/0022469 | A1 | 1/2012 | Alpert |
| 2012/0053555 | A1 | 3/2012 | Ariagno et al. |
| 2012/0059332 | A1 | 3/2012 | Woehr et al. |
| 2012/0059346 | A1 | 3/2012 | Sheppard et al. |
| 2012/0067429 | A1 | 3/2012 | Mosler et al. |
| 2012/0071819 | A1 | 3/2012 | Bruggemann et al. |
| 2012/0078214 | A1 | 3/2012 | Finke et al. |
| 2012/0123382 | A1 | 5/2012 | Kubo |
| 2012/0184938 | A1 | 7/2012 | Lev et al. |
| 2012/0215182 | A1 | 8/2012 | Mansour et al. |
| 2012/0220977 | A1 | 8/2012 | Yow |
| 2012/0220978 | A1 | 8/2012 | Lev |
| 2012/0265163 | A1 | 10/2012 | Cheng et al. |
| 2012/0271229 | A1 | 10/2012 | Lev et al. |
| 2012/0296307 | A1 | 11/2012 | Holt et al. |
| 2012/0310203 | A1 | 12/2012 | Khaled et al. |
| 2012/0323172 | A1 | 12/2012 | Lev et al. |
| 2012/0323187 | A1 | 12/2012 | Iwase et al. |
| 2012/0323210 | A1 | 12/2012 | Lev et al. |
| 2013/0046269 | A1 | 2/2013 | Lev et al. |
| 2013/0053814 | A1 | 2/2013 | Mueller-Beckhaus et al. |
| 2013/0096493 | A1 | 4/2013 | Kubo et al. |
| 2013/0110049 | A1 | 5/2013 | Cronenberg et al. |
| 2013/0144248 | A1 | 6/2013 | Putter et al. |
| 2013/0199669 | A1 | 8/2013 | Moy et al. |
| 2013/0226100 | A1 | 8/2013 | Lev |
| 2013/0231630 | A1 | 9/2013 | Kraus et al. |
| 2013/0237904 | A1 | 9/2013 | Deneburg et al. |
| 2013/0253448 | A1 | 9/2013 | Baron et al. |
| 2013/0289530 | A1 | 10/2013 | Wyatt et al. |
| 2014/0020793 | A1 | 1/2014 | Denenburg et al. |
| 2014/0096862 | A1 | 4/2014 | Aneas |
| 2014/0150911 | A1 | 6/2014 | Hanner et al. |
| 2014/0194854 | A1 | 7/2014 | Tsals |
| 2014/0221940 | A1 | 8/2014 | Clauson et al. |
| 2014/0277052 | A1 | 9/2014 | Haselby et al. |
| 2014/0352845 | A1 | 12/2014 | Lev et al. |
| 2015/0082746 | A1 | 3/2015 | Ivosevic et al. |
| 2015/0088078 | A1 | 3/2015 | Lev et al. |
| 2015/0290390 | A1 | 10/2015 | Ring et al. |
| 2015/0305770 | A1 | 10/2015 | Fill et al. |
| 2016/0088995 | A1 | 3/2016 | Ueda et al. |
| 2016/0199569 | A1 | 7/2016 | Yevmenenko et al. |
| 2016/0228644 | A1 | 8/2016 | Cabiri |
| 2016/0287475 | A1 | 10/2016 | Yevmenenko et al. |

FOREIGN PATENT DOCUMENTS

| | | | |
|---|---|---|---|
| CN | 1863566 | A | 11/2006 |
| CN | 1950049 | A | 4/2007 |
| CN | 101001661 | A | 7/2007 |
| CN | 101687083 | A | 3/2010 |
| DE | 1064693 | B | 9/1959 |
| DE | 1913926 | A1 | 9/1970 |
| DE | 4122476 | A1 | 1/1993 |
| DE | 19504413 | A1 | 8/1996 |
| DE | 202004012714 | U1 | 11/2004 |
| DE | 202009011019 | U1 | 12/2010 |
| EM | 000627237-0001 | | 1/2007 |
| EM | 001680703-0002 | | 3/2010 |
| EP | 0192661 | A1 | 9/1986 |
| EP | 0195018 | A1 | 9/1986 |
| EP | 0258913 | A2 | 3/1988 |
| EP | 0416454 | A2 | 3/1991 |
| EP | 0282545 | B1 | 2/1992 |
| EP | 0518397 | A1 | 12/1992 |
| EP | 0521460 | A1 | 1/1993 |
| EP | 582038 | A2 | 2/1994 |
| EP | 0598918 | A1 | 6/1994 |
| EP | 0637443 | A1 | 2/1995 |
| EP | 0737467 | A1 | 10/1996 |
| EP | 761562 | A1 | 3/1997 |
| EP | 765652 | A1 | 4/1997 |
| EP | 765853 | A1 | 4/1997 |
| EP | 0806597 | A1 | 11/1997 |
| EP | 0814866 | A1 | 1/1998 |
| EP | 829248 | A2 | 3/1998 |
| EP | 0856331 | A2 | 8/1998 |
| EP | 882441 | A2 | 12/1998 |
| EP | 0887085 | A2 | 12/1998 |
| EP | 0887885 | A2 | 12/1998 |
| EP | 897708 | A2 | 2/1999 |
| EP | 0898951 | A2 | 3/1999 |
| EP | 960616 | A2 | 12/1999 |
| EP | 1008337 | A1 | 6/2000 |
| EP | 1029526 | A1 | 8/2000 |
| EP | 1034809 | A1 | 9/2000 |
| EP | 1051988 | A2 | 11/2000 |
| EP | 1323403 | A1 | 7/2003 |
| EP | 1329210 | A1 | 7/2003 |
| EP | 1396250 | A1 | 3/2004 |
| EP | 1454609 | A1 | 9/2004 |
| EP | 1454650 | A1 | 9/2004 |
| EP | 1498097 | A2 | 1/2005 |
| EP | 1872824 | A1 | 1/2008 |
| EP | 1911432 | A1 | 4/2008 |
| EP | 1919432 | A1 | 5/2008 |
| EP | 1930038 | A2 | 6/2008 |
| EP | 2090278 | A1 | 8/2009 |
| EP | 2351548 | A1 | 8/2011 |
| EP | 2351549 | A1 | 8/2011 |
| EP | 2462913 | A1 | 6/2012 |
| EP | 2512399 | A1 | 10/2012 |
| FR | 2029242 | A5 | 10/1970 |
| FR | 2856660 | A1 | 12/2004 |
| FR | 2869795 | A1 | 11/2005 |
| FR | 2931363 | A1 | 11/2009 |
| GB | 1444210 | A | 7/1976 |
| IL | 171662 | | 10/2005 |
| IL | 186290 | | 1/2008 |
| JP | 03-0642426 | B | 9/1991 |
| JP | 4329954 | A | 11/1992 |
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | A | 5/1998 |
| JP | H10-504736 | A | 5/1998 |
| JP | 11503627 | T | 3/1999 |
| JP | 11-319031 | A | 11/1999 |
| JP | 2000-508934 | A | 7/2000 |
| JP | 2000-237278 | A | 9/2000 |
| JP | 2000262497 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-501721 | A | 1/2004 |
| JP | 2004-097253 | A | 4/2004 |
| JP | 2004-522541 | A | 7/2004 |
| JP | 2005-270629 | A | 10/2005 |
| JP | 200661421 | A | 3/2006 |
| JP | 2008-220961 | A | 9/2008 |

(56) References Cited

FOREIGN PATENT DOCUMENTS

| | | | |
|---|---|---|---|
| JP | 2010-179128 | A | 8/2010 |
| JP | 2012-205769 | A | 10/2012 |
| JP | 2014000220 | A | 1/2014 |
| WO | 8601712 | A1 | 3/1986 |
| WO | 8605683 | A1 | 10/1986 |
| WO | 9003536 | A1 | 4/1990 |
| WO | 9403373 | A1 | 2/1994 |
| WO | 9507066 | A1 | 3/1995 |
| WO | 9600053 | A1 | 1/1996 |
| WO | 9609083 | A1 | 3/1996 |
| WO | 9629113 | A1 | 9/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 0128490 | A1 | 4/2001 |
| WO | 0130425 | A1 | 5/2001 |
| WO | 01352524 | A1 | 5/2001 |
| WO | 0160311 | A1 | 8/2001 |
| WO | 0189607 | A2 | 11/2001 |
| WO | 0191693 | A2 | 12/2001 |
| WO | 0202165 | A2 | 1/2002 |
| WO | 200209797 | A1 | 2/2002 |
| WO | 0232372 | A1 | 4/2002 |
| WO | 02066100 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2005002492 | A1 | 1/2005 |
| WO | 2005018703 | A2 | 3/2005 |
| WO | 0236191 | A2 | 5/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007101772 | A1 | 9/2007 |
| WO | 2007105221 | A1 | 9/2007 |
| WO | 2008076459 | A1 | 6/2008 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010078227 | A1 | 7/2010 |
| WO | 2010117580 | A1 | 10/2010 |
| WO | 2011004360 | A1 | 1/2011 |
| WO | 2011039747 | A1 | 4/2011 |
| WO | 2011058545 | A1 | 5/2011 |
| WO | 2011058548 | A1 | 5/2011 |
| WO | 2011077434 | A1 | 6/2011 |
| WO | 2011090955 | A1 | 7/2011 |
| WO | 2011104711 | A1 | 9/2011 |
| WO | 2011156373 | A1 | 12/2011 |
| WO | 2012004784 | A1 | 1/2012 |
| WO | 2012063230 | A1 | 5/2012 |
| WO | 2012143921 | A1 | 10/2012 |
| WO | 2012150587 | A1 | 11/2012 |
| WO | 2013127813 | A1 | 9/2013 |
| WO | 2013134246 | A1 | 9/2013 |
| WO | 2013148435 | A1 | 10/2013 |
| WO | 2013156944 | A1 | 10/2013 |
| WO | 2013156994 | A1 | 10/2013 |
| WO | 2014033706 | A2 | 3/2014 |
| WO | 2014033710 | A1 | 3/2014 |
| WO | 2014174278 | A1 | 10/2014 |
| WO | 2016023590 | A1 | 2/2016 |

OTHER PUBLICATIONS

Novel Transfer, Mixing and Drug Delivery Systems, MOP Medimop Medical Projects Ltd. Catalog, 4 pages, Rev. 4, 2004.

Smart Site.RTM. Alaris Medical Systems Product Brochure, 4 pages, Issue 1, Oct. 1999.

MixJect, downloaded from webpage: http://www.westpharma.com/en/products/Pages/MixjecLaspx, Download Date: Aug. 8, 2012, 1 page.

MixJet Product Information Sheet, downloaded from webpage: http://www.westpharma.com/SiteCollectionDocuments/Recon/mixject%20product%20sheet.pdf; 1 page.

The MixJect transfer system, as shown in the article, "Advanced Delivery Devices," Drug Delivery Technology Jul./Aug. 2007 vol. 7 No. 7 [on-line]. [Retrieved from Internet May 14, 2010]. URL: <http://www.drugdeiverytech-online.com/drugdelivery/200707/?pg=28pg28>. (3 pages).

Publication date of Israeli Patent Application 186290 [on-line]. [Retrieved from Internet May 24, 2010]. URL:<http://www.ilpatsearch.justrice.gov.il/UI/RequestsList.aspx>. (1 page).

Silicone Rubber Overview Downloaded from webpage: http://www.knovel.com/web/portal/browse/display?_EXT_KNOVEL_DISPLAY_bookid=1023&VerticalID=0 on Feb. 9, 2011, Download Date: Sep. 2, 2011, Original Posting Date: 2010, 6 pages.

U.S. Appl. No. 13/498,378 by Lev, filed Mar. 27, 2012.

Kipp, "Plastic Material Data Sheets," retrieved from the internet: http://www.knovel.com/web/portal/browse/display?_EXT_KNOVEL_DISPLAY_bookid=1023&VerticalID=0, retrieved on Feb. 9, 2011.

U.S. Appl. No. 13/505,790 by Lev, filed May 3, 2012.

U.S. Appl. No. 13/505,881 by Lev, filed May 3, 2012.

U.S. Appl. No. 13/522,410 by Lev, filed Jul. 16, 2012.

U.S. Appl. No. 13/576,461 by Lev, filed Aug. 1, 2012.

Alaris Medical Systems Product Brochure, 4 pages, Issue 1, Oct. 11, 1999.

Smart Site Needle-Free Systems, Alaris Medical Systems Webpage, 4 pages, Feb. 2006.

Photographs of Alaris Medical Systems SmartSite.RTM. device, 5 pages, 2002.

Non-Vented Vial Access Pin with Ultrasite.RTM. Valve, B. Braun Medical, Inc. website and product description, 3 pages, Feb. 2006.

U.S. Appl. No. 29/438,134 by Lev, filed Nov. 27, 2012.

U.S. Appl. No. 29/438,141 by Gilboa, filed Nov. 27, 2012.

U.S. Appl. No. 13/883,289 by Lev, filed May 3, 2013.

U.S. Appl. No. 13/884,981 by Denenburg, filed May 13, 2013.

U.S. Appl. No. 14/005,751 by Denenburg, filed Sep. 17, 2013.

IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).

Drug Administration Systems product information sheets; http://www.westpharma.com/eu/en/products/Pages/Vial2Bag.aspx; pp. 1-3 (admitted prior art).

Article with picture of West Pharmaceutical Services' Vial2Bag Needleless System, [on-line]; ISIPS Newsletter, Oct. 26, 2007]; retrieved from Internet Feb. 16, 2010]; URL:<http://www.isips.org/reports/ISIPS_Newsletter_October_26_2007. html.> (7 pages see pp. 5-6).

Translation of Office Action dated Jun. 18, 2012 in JP Application No. 2008-538492.

Translation of Office Action dated Apr. 15, 2013 in JP Application No. 2008-538492.

Written Opinion dated Aug. 16, 2012 in Int'l Application No. PCT/IL2012/000164.

U.S. Appl. No. 29/478,723 by Lev, filed Jan. 8, 2014.

U.S. Appl. No. 29/478,726 by Lev, filed Jan. 8, 2014.

U.S. Appl. No. 14/345,094 by Lev, filed Mar. 14, 2014.

U.S. Appl. No. 14/366,306 by Lev, filed Jun. 18, 2014.

U.S. Appl. No. 14/385,212 by Lev, filed Sep. 15, 2014.

(56) References Cited

OTHER PUBLICATIONS

U.S. Appl. No. 29/502,037 by Lev, filed Sep. 11, 2014.
U.S. Appl. No. 29/502,053 by Lev, filed Sep. 11, 2014.
U.S. Appl. No. 14/391,792 by Lev, filed Oct. 10, 2014.
U.S. Appl. No. 14/504,979 by Lev, filed Oct. 2, 2014.
U.S. Appl. No. 14/423,595 by Lev, filed Feb. 24, 2015.
U.S. Appl. No. 14/423,612 by Lev, filed Feb. 24, 2015.
U.S. Appl. No. 14/425,582 by Lev, filed Mar. 3, 2015.
U.S. Appl. No. 14/888,590 by Marks, filed Nov. 2, 2015.
U.S. Appl. No. 14/784,300 by Lev, filed Oct. 14, 2015.
U.S. Appl. No. 29/544,969 by Ben Shalom, filed Nov. 9, 2015.
West, Vial2Bag DC system, Oct. 2, 2014, https://web.archive.org/web/20141002065133/http://www.westpharma.com/en/products/Pages/Reconstitutionsystems.aspx.
Vial2Bag DC, downloaded from webpage: https://www.youtube.com/watch?v=FEOkglxNBrs, Original posting date: Aug. 21, 2014, 1 page.
Vial-Mate Adapter Device, Baxter, May 2017, downloaded from web page:http://www.baxtermedicationdeliveryproducts.com/drug-delivery/vialmate.html, Download Date: Jul. 28, 2017, original posting date: unknown, 1page.
Int'l Search Report and Written Opinion dated Sep. 14, 2016 in Int'l Application No. PCT/IL2016/050709.

* cited by examiner

LIQUID DRUG TRANSFER DEVICES FOR SECURE TELESCOPIC SNAP FIT ON INJECTION VIALS

CROSS-REFERENCE TO RELATED APPLICATIONS

This application is a Section 371 of International Application No. PCT/IL2016/50709, filed Jul. 1, 2016, which was published in the English language on Jan. 19, 2017, under International Publication No. WO 2017/009822 A1, which claims priority under 35 U.S.C. § 119(b) to Israeli Application No. 240005, filed Jul. 16, 2015, the disclosures of which are incorporated herein by reference in their entirety.

BACKGROUND OF THE INVENTION

The invention relates to liquid drug transfer devices for secure telescopic snap fit on injection vials.

ISO 8362-1 Injection containers and accessories—Part 1: injection vials made of glass tubing standardizes vial sizes, vial dimensions and vial tolerances. ISO 8362-1 defines the following terms: Vial tube, vial crown and vial neck intermediate a vial tube and a vial crown. The vial tube has a closed end and an Outer Diameter (OD) d1. The vial crown has a crown opening and an Outer Diameter (OD) d2. The vial neck has an Outer Diameter (OD) d3 and an Inner Diameter (ID) d4. The vial crown has an uppermost vial crown rim encircling the crown opening and a lowermost vial crown rim towards the vial neck. The crown opening has the same inner diameter as the vial neck. The injection vial has a vial shoulder between the vial neck and the vial tube. The vial tube and the vial shoulder meet at an uppermost vial tube rim. The diameters have the relationship: d1>d2>d3>d4. Most vial crown outer diameters are available in several vial tube outer diameters, for example, a vial crown outer diameter d2=20 mm is available in three standard vial tube outer diameters d1=22 or 24 or 30 mm. Accordingly, injection vials are referred to by their vial crown outer diameters and not their vial tube outer diameters.

Liquid drug transfer devices include a vial adapter having a transverse vial adapter top wall, a hollow puncturing cannula for puncturing a vial stopper and a downward depending skirt. The downward depending skirt extends sufficiently downward to shield a puncturing cannula tip to prevent inadvertent user contact therewith. The downward depending skirt is shaped and dimensioned to snugly telescopically snap fit onto a particular vial crown outer diameter. Accordingly, vial adapters in a similar manner to injection vials are referred to in terms of a vial crown outer diameter for which they are intended to telescopic snap fit thereon. To ensure a vial adapter can be telescopically snap fit onto all the standard vial tube outer diameters of a particular vial crown outer diameter, its downward depending skirt is dimensioned to terminate above a vial shoulder. However, such downward depending skirts do not assist a user to align a vial adapter co-axial with an injection vial leading to common misalignment. Misalignment of a vial adapter with respect to an injection vial typically leads to the formation of a tear in a vial stopper as discussed in inter alia commonly owned U.S. Pat. No. 8,608,723 to Lev et al. entitled Fluid Transfer Devices with Sealing Arrangement.

Commonly owned U.S. Pat. No. 8,070,739 to Zinger et al. entitled Liquid Drug Transfer Devices for Failsafe Correct Snap Fitting onto Medicinal Vials discloses liquid drug transfer devices having a vial adapter designed to assist a user to align a vial adapter with an injection vial. The liquid drug transfer devices include a vial adapter having a downward depending skirt with at least two non-adjacent vial retention flex members for snap fitting over a vial crown for vial retention purposes and at least two non-adjacent vial guidance flex members longer than their counterpart vial retention flex members for guiding a vial adapter with respect to an injection vial prior to snap fitting the vial adapter thereon.

During the snap fit on an injection vial, the vial guidance flex members typically abut a vial shoulder and slide radial outwards on being outwardly radially flexed with respect to their vial adapter centerline at their junctures with their vial adapter top wall. The outward radial sliding of vial guidance flex members is dependent on the slope of a vial shoulder with a steeper slope facilitating outward radial sliding. The outward radial flexing of the vial guidance flex members at the junctures with their vial adapter top wall leads to a detachment reaction force opposing a manual attachment force for telescopic snap fitting a vial adapter on an injection vial. The greater the diameter of an injection tube the greater a detachment reaction force which at best leads to weakening a telescopic snap fit and at worst can lead to detachment.

Moreover, the telescopic snap fit of a vial adapter on an injection vial is not uniform for all the vial tube outer diameters for a particular vial crown outer diameter because the vial guidance flex members are outwardly radially flexed differently for different vial tube outer diameters. Also, larger vial tube outer diameters cause a vial adapter telescopic snap fitted onto an injection vial to present an awkward gripping surface for a user holding the vial adapter, for example, for attaching and detaching a syringe.

There is therefore a need to provide liquid drug transfer devices with vial adapters for providing a secure telescopic snap fit on a vial crown for all standard vial tube outer diameters for a particular vial crown outer diameter.

BRIEF SUMMARY OF THE INVENTION

The present invention is directed towards liquid drug transfer devices including a vial adapter designed for secure telescopic snap fit on an injection vial. The liquid drug transfer devices have a similar construction as hitherto described U.S. Pat. No. 8,070,739 liquid drug transfer devices but their vial guidance flex members are additionally provisioned with a purpose design hinged zone distanced from a vial adapter top wall for intentional hinging thereat on telescopic snap fitting on an injection vial as opposed to flexing at a vial adapter top wall. The hinged zones preclude a vial adapter developing a significant detachment reaction force opposing a manual attachment force as may arise in the case of hitherto described U.S. Pat. No. 8,070,739 liquid drug transfer devices. Accordingly, the liquid drug transfer devices of the present invention can be readily used with injection vials of all vial tube outer diameters for a specific vial crown outer diameter. The liquid drug transfer devices of the present invention can be provisioned with a puncturing cannula longer than its vial retention flex members and vial guidance flex members longer than its puncturing cannula for shielding same but without detracting from a secure telescopic snap fit on an injection vial.

The vial guidance flex members preferably have their hinged zones disposed opposite the at least partially circumferentially extending inwardly protruding vial retention ribs of their counterpart vial retention flex members such that vial guidance flex members also snugly encircle a vial crown on telescopic snap fitting a vial adapter on an injection vial without snap fitting thereon. Vial retention flex members can double as vial guidance flex members by also being formed with hinged zones in a similar manner to vial guidance flex members on the condition their hinged zones are necessarily disposed distal to their at least partially circumferentially extending inwardly protruding vial retention ribs with respect to a vial adapter top wall. Accordingly, liquid drug transfer devices of the present invention can be provisioned with vial retention flex members only with at least two vial retention flex members doubling as vial guidance flex members with hinged zones.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
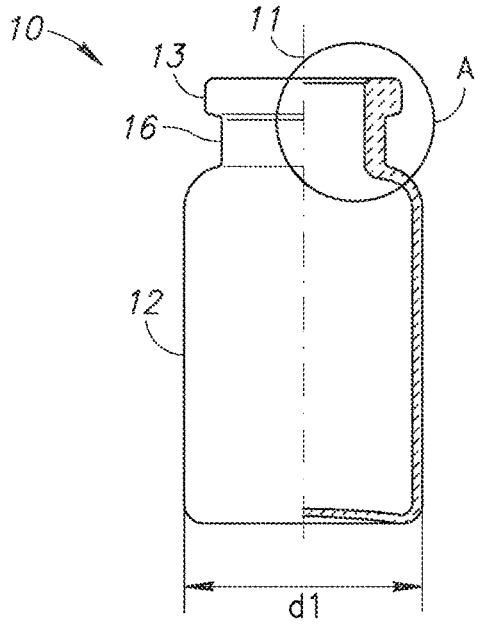
FIGS. 1 and 1A show ISO 8362-1 Section 4 Dimensions figure defining a vial tube outer diameter d1, a vial crown outer diameter d2, a vial neck outer diameter d3 and a vial neck inner diameter d4.
Figure 1A:
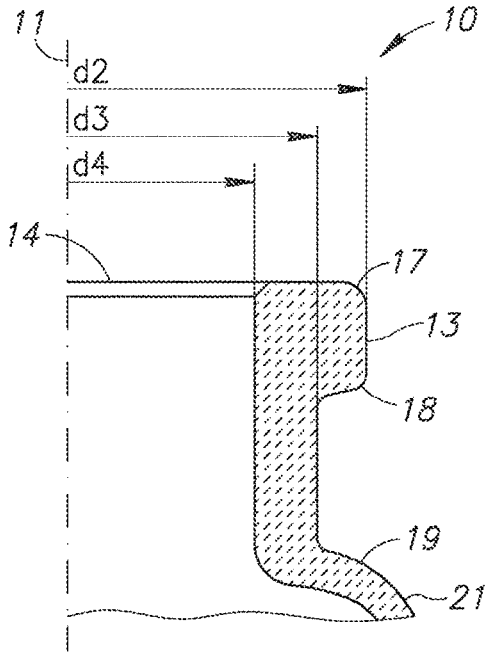
Figure 4:
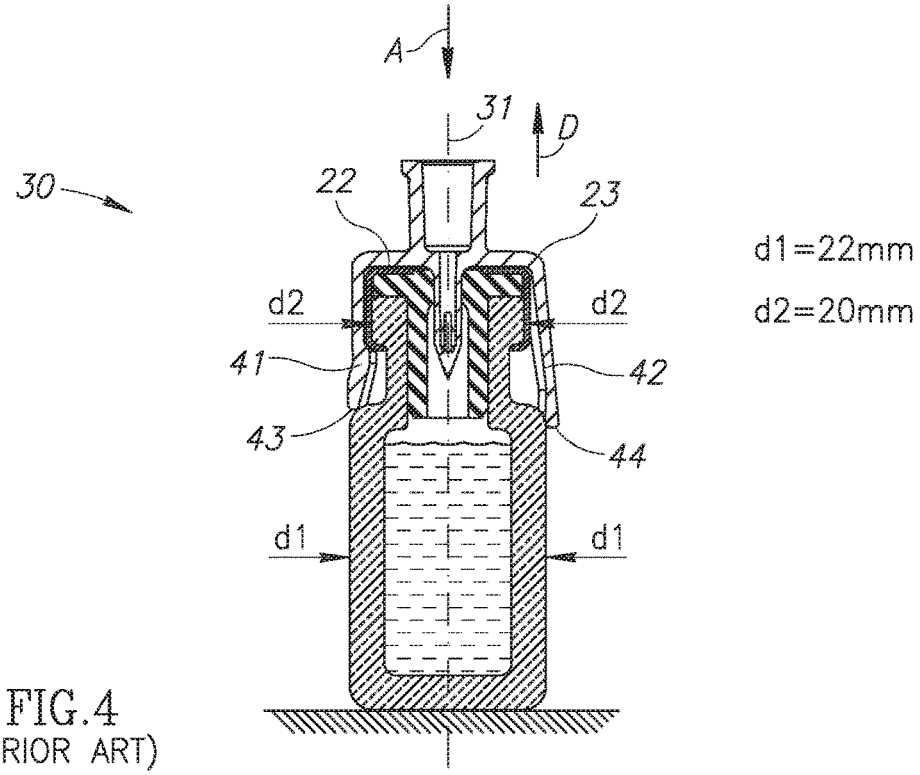
FIG.4 (PRIOR ART)
FIG. 4 is a longitudinal cross section along line A-A in FIG. 2 showing FIG. 2's 20 mm female vial adapter telescopic snap fit on a 20 mm injection vial having a vial tube outer diameter d1=22 mm.
Figure 5:
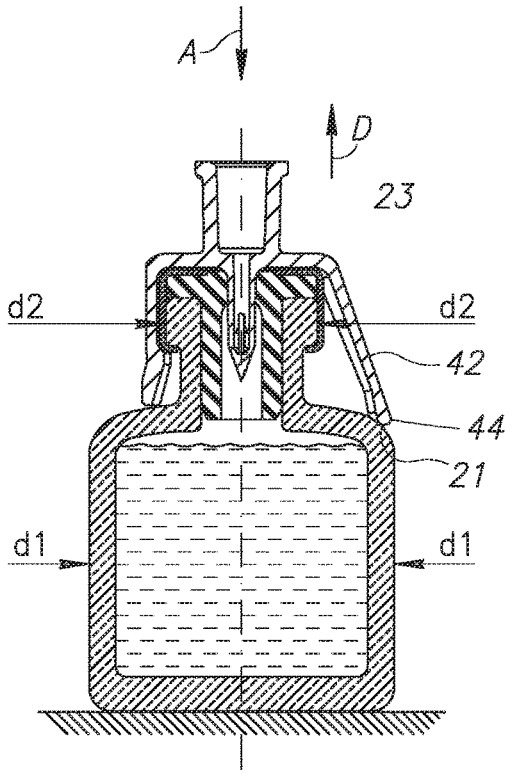
FIG.5 (PRIOR ART)
FIG. 5 is a longitudinal cross section along line A-A in FIG. 2 showing FIG. 2's 20 mm female vial adapter telescopic snap fit on a 20 mm injection vial having a vial tube outer diameter d1=30 mm.

FIGS. 1 and 1A show an injection vial 10 having a longitudinal injection vial centerline 11 and including a closed end vial tube 12, a tubular vial crown 13 having a crown opening 14 and a vial neck 16 intermediate the vial tube 12 and the vial crown 13. The vial crown 13 has an uppermost vial crown rim 17 encircling the crown opening 14 and a lowermost vial crown rim 18 towards the vial neck 16. The injection tube 10 includes a vial shoulder 19 intermediate the vial tube 12 and the vial neck 16. The vial tube 12 and the vial shoulder 19 meet at an uppermost vial tube rim 21. The vial tube 12 has an outer diameter d1. The vial crown 13 has an outer diameter d2. The vial neck 16 has an outer diameter d3 and an inner diameter d4. The crown opening 14 has the same inner diameter as the vial neck 16. The diameters have the relationship d1>d2>d3>d4. In the case of vial crown outer diameter d2=20 mm, the injection tube outer diameter d1 can be one of three standard diameters: d1=22 or 24 or 30 mm. FIGS. 4 and 5 show the injection vial 10 also includes a vial stopper 22 for stopping the crown opening 14 and an aluminum band 23 sealing the vial stopper 22.

Figure 2:
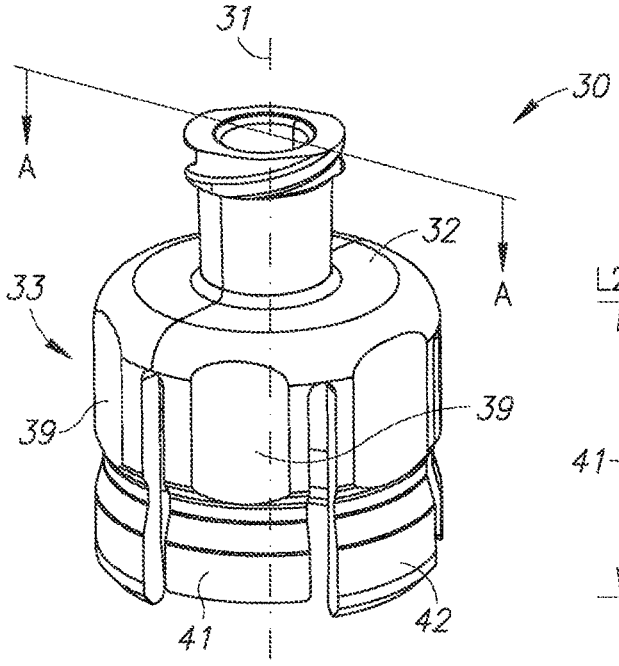
FIG.2 (PRIOR ART)
FIG. 2 is a perspective view of a conventional 20 mm female vial adapter in accordance with U.S. Pat. No. 8,070,739.
Figure 3:
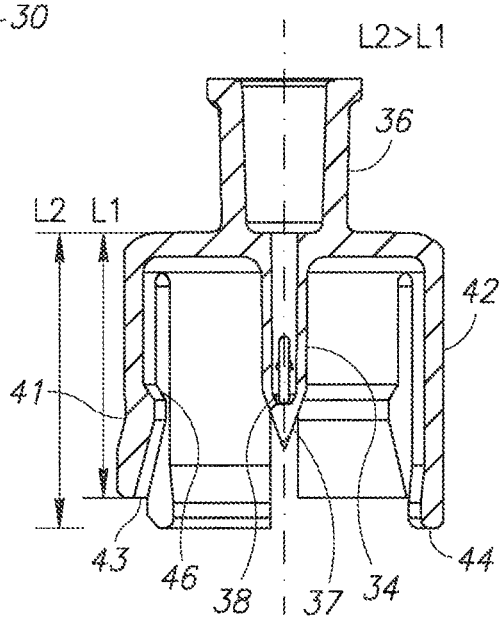
FIG.3 (PRIOR ART)
FIG. 3 is a longitudinal cross section of FIG. 2's 20 mm female vial adapter along line A-A in FIG. 2.

FIGS. 2 and 3 show a conventional liquid drug transfer device 30 in accordance with hitherto mentioned U.S. Pat. No. 8,070,739 constituted by a female vial adapter for telescopic snap fit on a 20 mm injection vial. The female vial adapter 30 has a longitudinal vial adapter centerline 31 and includes a vial adapter top wall 32 transverse to the longitudinal vial adapter centerline 31 and a substantially cylindrical skirt 33 downwardly depending from the vial adapter top wall 32 for telescopically slidingly receiving a vial crown therein. The vial adapter top wall 32 includes a downward depending hollow puncturing cannula 34 for puncturing a vial stopper. The vial adapter top wall 32 includes a fluid transfer port 36 constituted by an upright female Luer connector opposite the puncturing cannula 34 and in flow communication therewith. The puncturing cannula 34 includes a puncturing cannula tip 37 with at least one flow aperture 38 for accessing a vial tube.

The skirt 33 includes six flex members 39 constituted by alternate vial retention flex members 41 and vial guidance flex members 42 equispaced around the longitudinal vial adapter centerline 31. The three vial retention flex members 41 and the three vial guidance flex members 42 occupy equal peripheral length around the longitudinal vial adapter centerline 31 in a top plan view of the female vial adapter 30.

The vial retention flex members 41 have vial retention flex member tips 43 at a length L1 from the vial adapter top wall 32. The vial guidance flex members 42 have vial guidance flex member tips 44 at a length L2 from the vial adapter top wall 32 wherein L2>L1. The vial retention flex members 41 having partially circumferentially extending inwardly protruding vial retention ribs 46 for snap fitting over a vial crown for vial retention purposes.

FIGS. 4 and 5 show the 20 mm female vial adapter 30 correspondingly telescopic snap fit on 20 mm injection vials having a 22 mm vial tube outer diameter and a 30 mm vial tuber outer diameter. FIG. 4 shows the vial guidance flex members 42 are slightly outwardly radially flexed at the vial adapter top wall 32 with respect to the vial adapter centerline 31 similar as shown in U.S. Pat. No. 8,070,739's FIG. 3E. FIG. 5 shows the vial guidance flex members 42 are more outwardly radially flexed at the vial adapter top wall 32 with respect to the vial adapter centerline 31 compared to FIG. 4. The female vial adapter 30 presents a detachment reaction force denoted D opposing a manual attachment force denoted A. A greater detachment reaction force D is felt by a user in the case of FIG. 5's 30 mm vial tube outer diameter than FIG. 4's 20 mm vial tube outer diameter.

FIGS. 4 and 5 show the vial retention flex members 41 and vial guidance flex members 42 do not snugly embrace the vial crown 13 in a uniform manner. In FIG. 4, since the vial tube outer diameter is only slightly greater than the vial crown outer diameter, the difference between the two types of flex members 41 and 42 is conceivably unnoticeable by a user holding the female vial adapter 30 during attachment and detachment of a syringe. In FIG. 5, such outward radial flexing is highly noticeable by a user holding the female vial adapter 30 during attachment and detachment of a syringe thereby presenting an awkward gripping surface for a user holding the female vial adapter 30.

Figure 6:
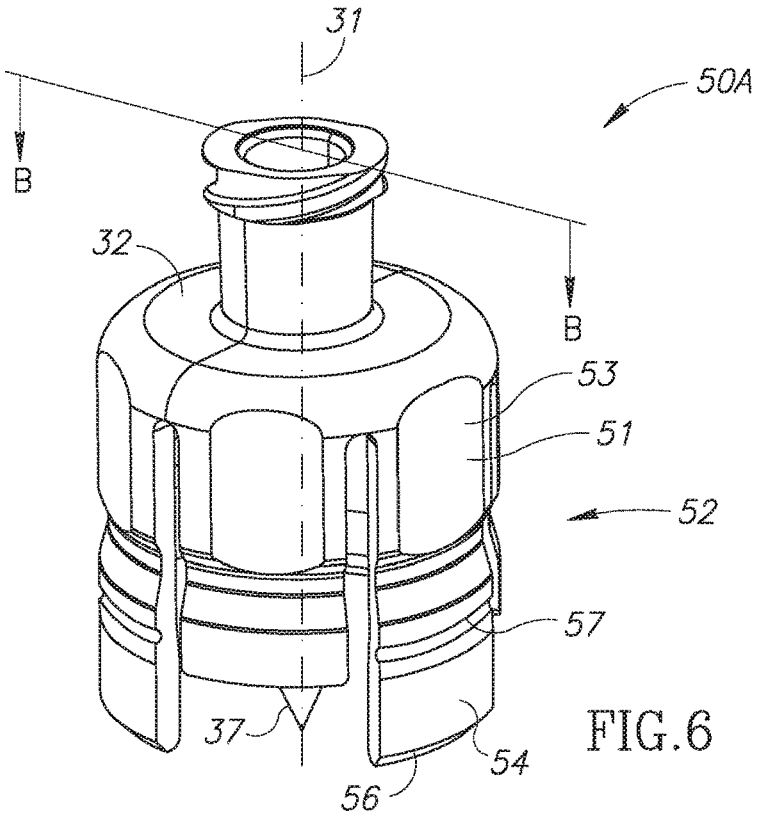
FIG. 6 is a perspective view of a 20 mm female vial adapter in accordance with a first embodiment of the present invention.
Figure 7:
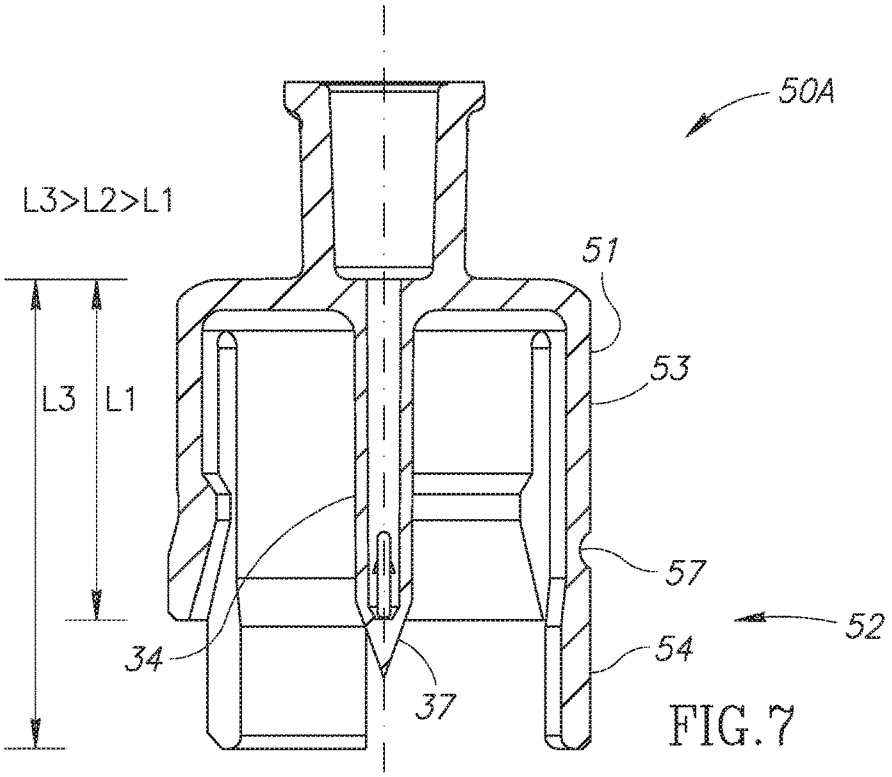
FIG. 7 is a longitudinal cross section of FIG. 6's 20 mm female vial adapter along line B-B in FIG. 6.

FIGS. 6 and 7 show a liquid drug transfer device 50A constituted by a female vial adapter for telescopic snap fit mounting on a 20 mm injection vial 10. The female vial adapter 50A has a similar construction and use as the female vial adapter 30 and therefore similar parts are likewise numbered. The female vial adapter 50A differs from the female vial adapter 30 insofar as the latter 50A has a puncturing cannula 34 longer than the vial retention flex members 41. Also the latter 50A includes vial guidance flex members 51 each having a hinged zone 52 dividing each vial guidance flex member 51 into an upper vial guidance flex member section 53 proximal the vial adapter top wall 32 and a lower vial guidance flex member section 54 distal the vial adapter top wall 32. The vial guidance flex members 51 terminate at vial guidance flex member tips 56 at a length L3 from the vial adapter top wall 32 where L3>L2>L1.

Figure 12:
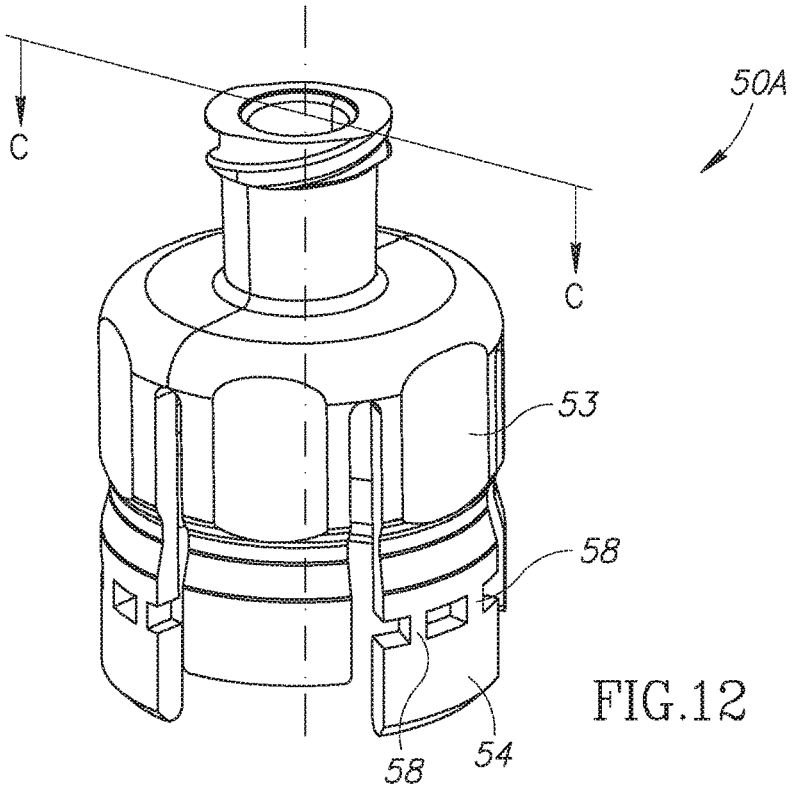
FIG. 12 is a perspective view of a 20 mm female vial adapter in accordance with a second embodiment of the present invention.
Figure 13:
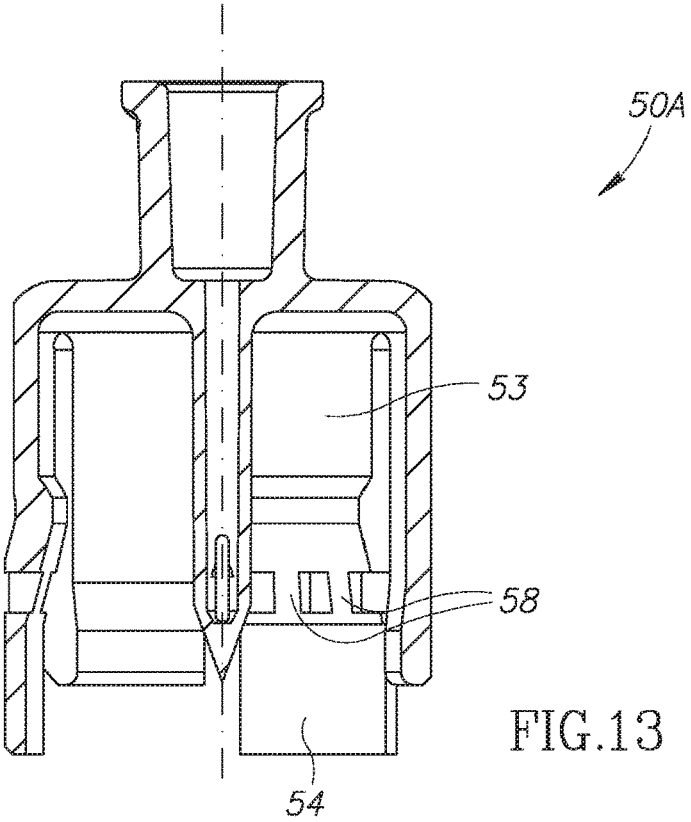
FIG. 13 is a longitudinal cross section of FIG. 12's 20 mm female vial adapter along line C-C in FIG. 12.

The vial retention flex members 41 having partially circumferentially extending inwardly protruding vial retention ribs 46 displaced from the vial adapter top wall 32. The hinged zones 52 are disposed substantially opposite the partially circumferentially extending inwardly protruding vial retention ribs 46. Accordingly, on telescopic snap fitting the female vial adapter 50A on a 20 mm injection vial 10, the hinged zones 52 are deployed between the lowermost vial crown rim 18 and the uppermost vial tube rim 21. The hinged zones 52 can be implemented, for example, by reducing material thickness, for example, by an external peripheral groove 57. Alternatively, the hinged zones 52 can be implemented by an upper vial guidance flex member 53 and a lower vial guidance flex member 54 being connected by two or more spaced apart hinges 58 as shown in FIGS. 12 and 13.

Figure 8:
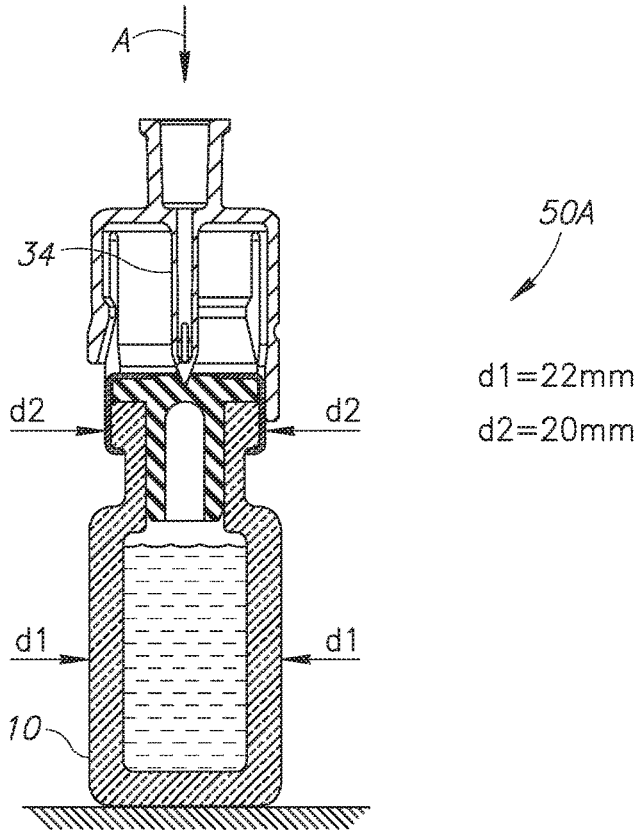
FIG. 8 is a longitudinal cross section showing FIG. 6's 20 mm female vial adapter prior to being telescopic snap fit on a 20 mm injection vial having a vial tube outer diameter d1=22 mm.
Figure 9:
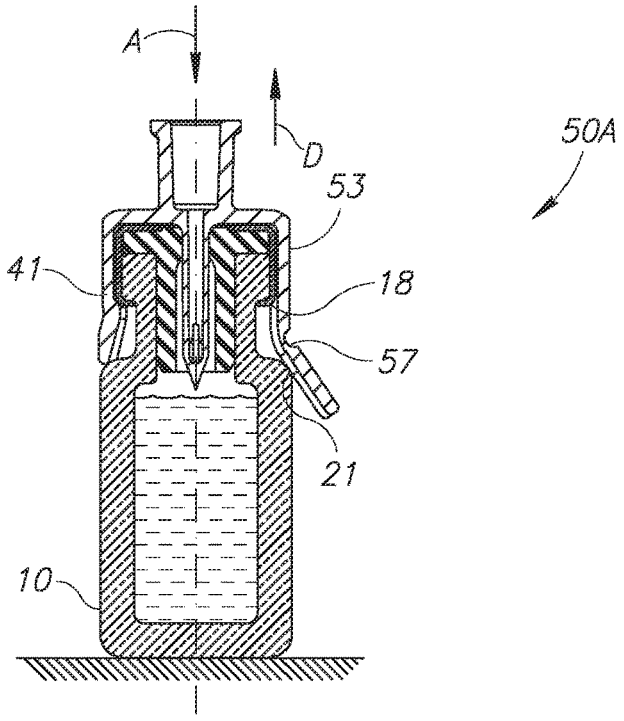
FIG. 9 is a longitudinal cross section showing FIG. 6's 20 mm female vial adapter telescopic snap fit on FIG. 8's injection vial.

FIGS. 8 and 9 show the female vial adapter 50A before and after telescopic snap fitting on an injection vial 10 with a 20 mm vial crown outer diameter and a 22 mm vial tube outer diameter. FIG. 8 shows the vial guidance flex members 51 assist centering of the female vial adapter 50A relative to the injection vial 10 as the female vial adapter 50A approaches the injection vial 10. On proceeding to depress the female vial adapter 50A towards the injection vial 10, the vial guidance flex members 51 initially slide down the aluminum band 23 until they contact the vial shoulder 19. The vial retention flex members 41 flex at their juncture with the vial adapter top wall 32 to snap fit over the vial crown 13 in a similar manner to the female vial adapter 30. FIG. 9 shows the vial guidance flex members 51 are outwardly radially hinged at their respective hinged zones 52 relative to the longitudinal vial adapter centerline 31 as a result of the vial guidance flex member tips 56 contacting the vial shoulder 19 and sliding radial outward towards the uppermost vial tube rim 21 rather than being flexed at their juncture with the vial adapter top wall 32. A user may feel a slight detachment reaction force D as he applies an attachment force A. FIG. 9 shows the upper vial guidance flex member sections 53 remain vertical similar to the vial retention flex members 41 unlike the vial guidance flex members 42 such that both the upper vial guidance flex member sections 53 and the vial retention flex members 41 snugly encircle the vial crown 13.

Figure 10:
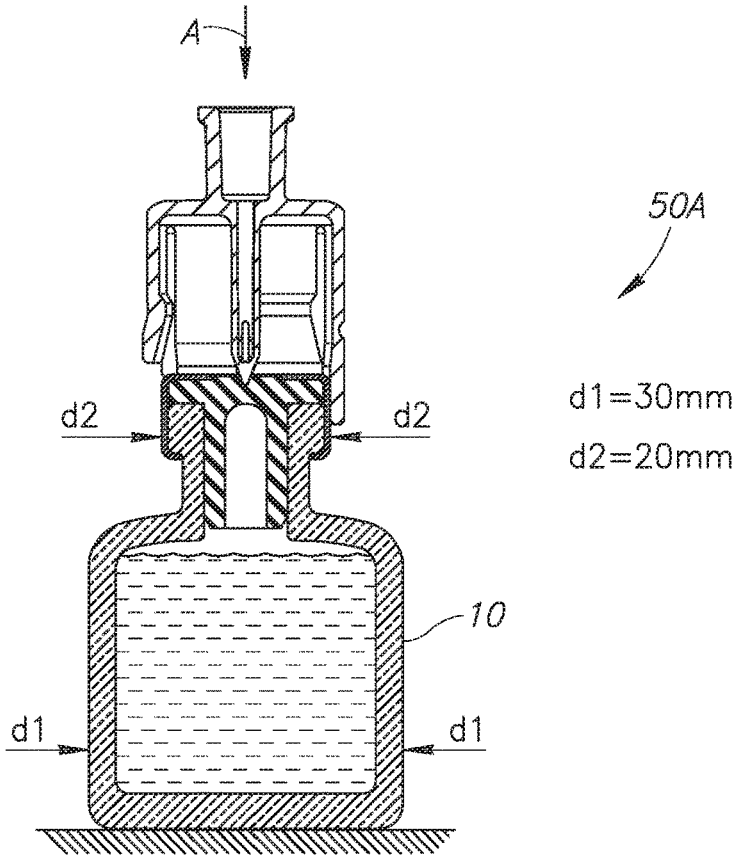
FIG. 10 is a longitudinal cross section showing FIG. 6's 20 mm female vial adapter prior to being telescopic snap fit on a 20 mm injection vial having a vial tube outer diameter d1=30 mm.
Figure 11:
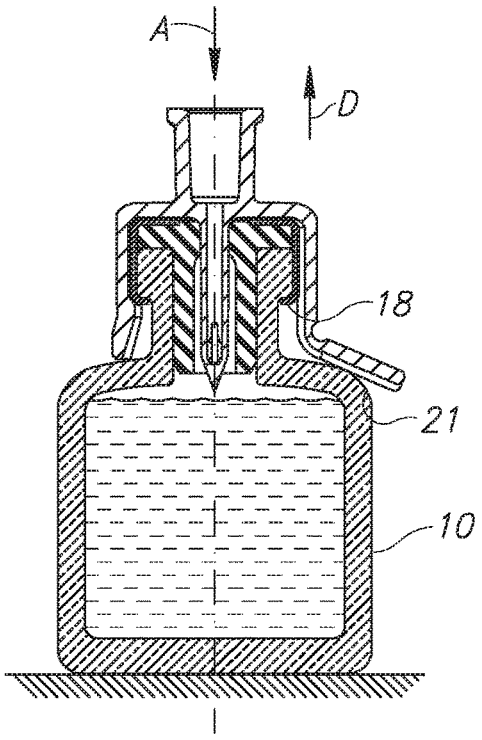
FIG. 11 is a longitudinal cross section showing FIG. 6's 20 mm female vial adapter telescopic snap fit on FIG. 10's injection vial.

FIGS. 10 and 11 correspond to FIGS. 8 and 9 and differ therefrom insofar as they show the female vial adapter 50A before and after telescopic snap fitting on an injection vial 10 with the same 20 mm vial crown outer diameter but with a 30 mm vial tube outer diameter. FIG. 11 shows the vial guidance flex members 51 are outwardly radially hinged at their respective hinged zones 52 relative to the longitudinal vial adapter centerline 31 as a result of the vial guidance flex member tips 56 contacting the vial shoulder 19 and sliding radial outwards towards the uppermost vial tube rim 21. A user may feel a slight detachment reaction force D as he applies an attachment force A considerably less than FIG. 5's detachment reaction force D. FIG. 11 shows the upper vial guidance flex member sections 53 remain vertical similar to the vial retention flex members 41 unlike the vial guidance flex members 42 such that both the upper vial guidance flex member sections 53 and the vial retention flex members 41 snugly encircle the vial crown 13. Thus, the female vial adapter 50A can be equally employed for telescopic snap fit on 20 mm injection vials of all its associated standard vial tube outer diameters 22 mm, 24 mm and 30 mm.

Figure 14:
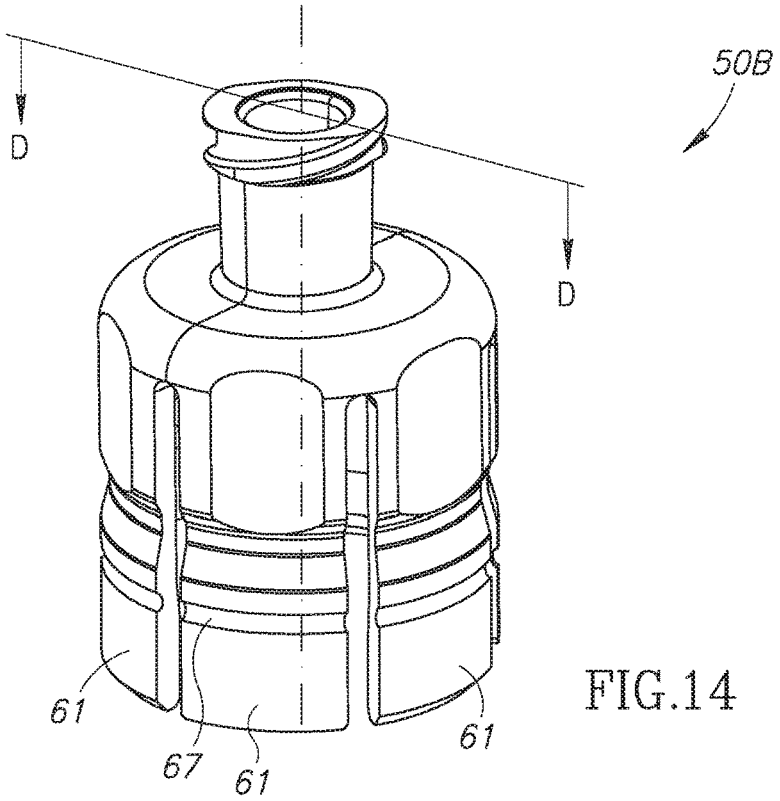
FIG. 14 is a perspective view of a 20 mm female vial adapter in accordance with a third embodiment of the present invention.
Figure 15:
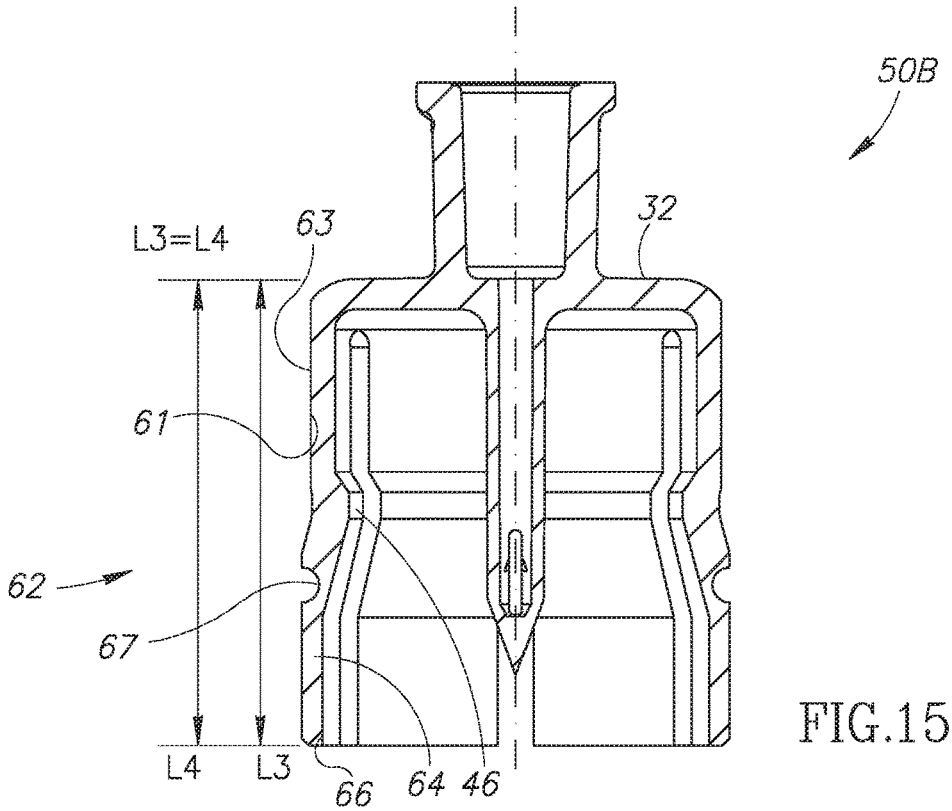
FIG. 15 is a longitudinal cross section of FIG. 14's 20 mm female vial adapter along line D-D in FIG. 14.

FIGS. 14 and 15 show a liquid drug transfer device 50B also constituted by a female vial adapter similar in construction and use as the female vial adapter 50A and therefore similar parts are likewise numbered. The latter 50B differs from the former 50A insofar as the latter 50B includes six vial retention flex members 61 and no vial guidance flex members. The six vial retention flex members 61 each include a hinged zone 62 similar to a hinged zone 52 thereby dividing each vial retention flex member 61 into an upper vial retention flex member section 63 proximal the vial adapter top wall 32 and a lower vial retention flex member section 64 distal the vial adapter top wall 32. The hinged zones 62 are necessarily disposed distal to the inwardly protruding vial retention ribs 46 with respect to the vial adapter top wall 32. The vial retention flex members 61 terminate at vial retention flex member tips 66 at a length L4 from the vial adapter top wall 32 where L4=L3. The hinged zones 62 are constituted by an external peripheral groove 67.

Figure 16:
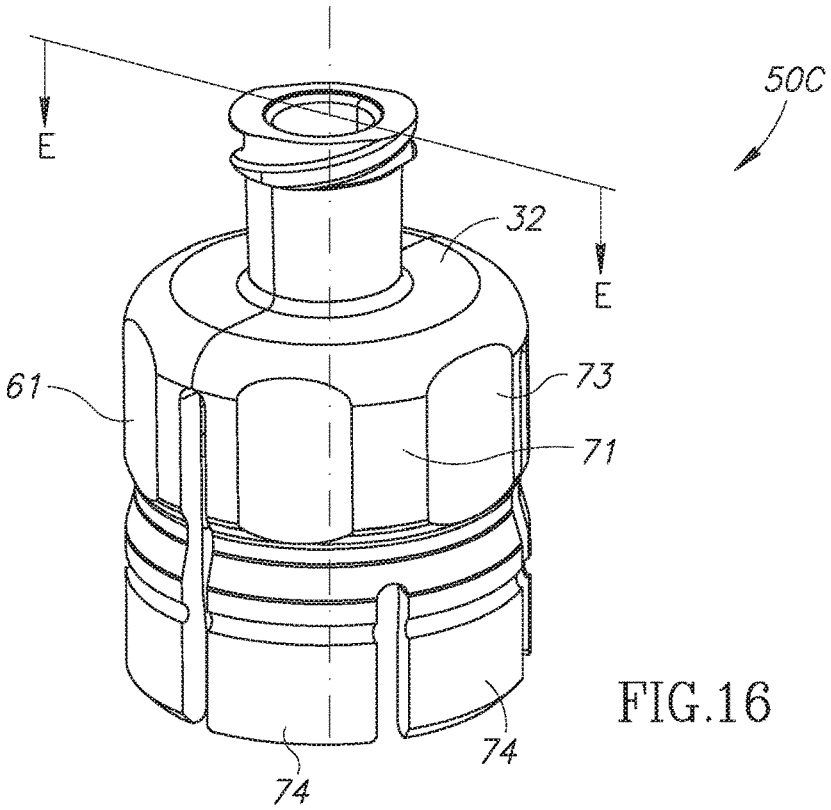
FIG. 16 is a perspective view of a 20 mm female vial adapter in accordance with a fourth embodiment of the present invention.
Figure 17:
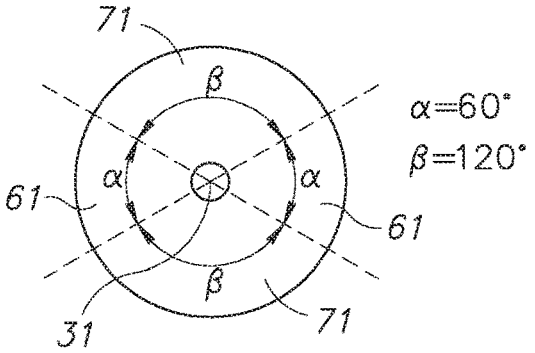
FIG. 17 is a top plan view of FIG. 16's female vial adapter.
Figure 18:
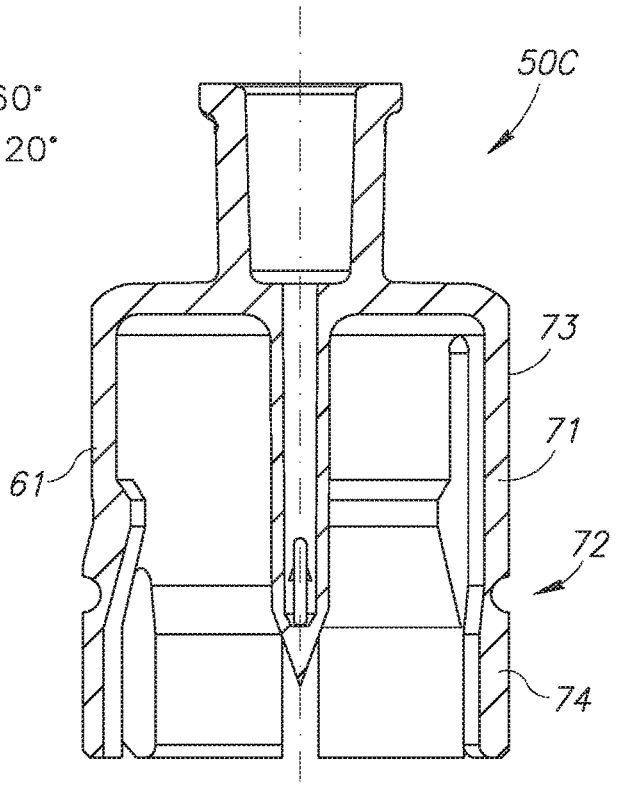
FIG. 18 is a longitudinal cross section of FIG. 16's 20 mm female vial adapter along line E-E in FIG. 16.

FIGS. 16 to 18 show a liquid drug transfer device 50C also constituted by a female vial adapter similar in construction and use as the female vial adapter 50B and therefore similar parts are likewise numbered. The female vial adapter 50C differs from the female vial adapter 50B insofar that it includes two diametric vial retention flex members 61 and two diametric vial guidance flex members 71. The two diametric vial guidance flex members 71 are designed to prevent any flexure at the vial adapter top wall 32 which may still occur in the case of the vial guidance flex members 51. Such prevention is achieved by the vial guidance flex members 71 subtend a section angle of at least 90° around the longitudinal vial adapter centerline 31 in FIG. 17's top plan view. Typically, the two vial retention flex members 61 each subtend a sector angle $\alpha=60°$ and the two vial guidance flex members 71 each subtend a sector angle $\beta=120°$.

The vial guidance flex members 71 each include a hinged zone 72 dividing each vial guidance flex member 71 into an upper vial guidance flex member section 73 proximal the vial adapter top wall 32 and a pair of spaced apart lower vial guidance flex member sections 74 distal the vial adapter top wall 32. The vial guidance flex members 71 terminate at vial guidance flex member tips 76. The lower vial guidance flex member sections 74 outwardly radially hinge at their respective hinged zones 72 relative to the longitudinal vial adapter centerline 31 as a result of the vial guidance flex member tips 76 contacting a vial shoulder 19 and sliding radial outwards towards an uppermost vial tube rim 21 on telescopic snap fitting the female vial adapter 50C on an injection vial 10.

Figure 19:
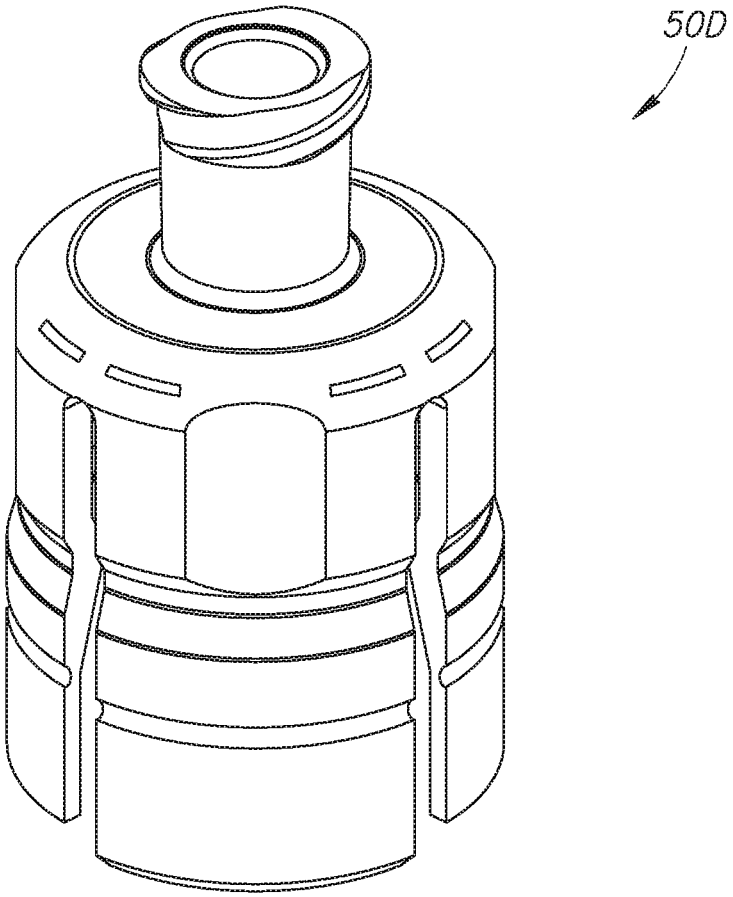
FIG. 19 is a perspective view of a vented 20 mm female vial adapter in accordance with a fifth embodiment of the present invention.

FIG. 19 shows a liquid drug transfer device 50D constituted by a vented female vial adapter in accordance with the teachings of the present invention.

Figure 20:
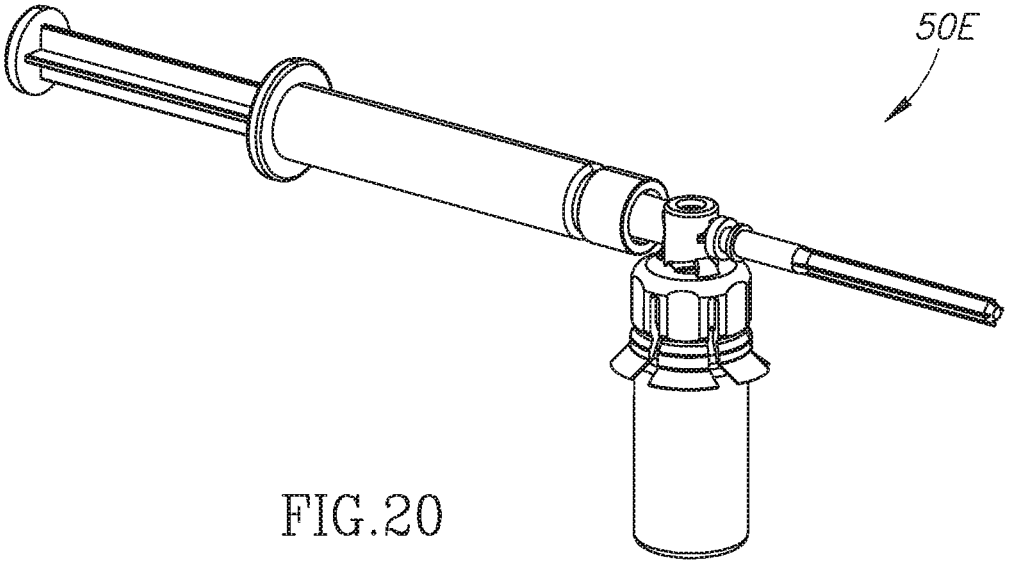
FIG. 20 is a perspective view of a liquid drug transfer device in accordance with a sixth embodiment of the present invention.

FIG. 20 shows a liquid drug transfer device 50E constituted by a fluid control device disclosed in commonly owned U.S. Pat. No. 6,238,372 to Zinger et al. and including a vial adapter in accordance with the teaching of the present invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A liquid drug transfer device for secure telescopic snap fitting on an injection vial having a longitudinal injection vial centerline and including a closed end vial tube, a tubular vial crown having a crown opening stopped by a vial stopper, a vial neck intermediate the vial tube and the vial crown, a vial shoulder intermediate the vial tube and the vial neck, the vial crown having an uppermost vial crown rim towards the crown opening and a lowermost vial crown rim towards the vial neck, the vial tube and the vial shoulder meeting at an uppermost vial tube rim, the vial tube having a vial tube outer diameter d1, the vial crown having a vial crown outer diameter d2, the vial neck having a vial neck outer diameter d3 and a vial neck inner diameter d4 wherein d1>d2>d3>d4 and the vial tube outer diameter d1 being selected from a predetermined range of at least one vial tube outer diameter d1 for the vial crown outer diameter d2, the liquid drug transfer device comprising:

(a) a vial adapter having a longitudinal vial adapter centerline and including a vial adapter top wall transverse to said longitudinal vial adapter centerline, a cylindrical skirt downwardly depending from said vial adapter top wall for telescopically slidingly receiving the vial crown therein, and a hollow puncturing cannula for puncturing the vial stopper, said puncturing cannula having a puncturing cannula tip with at least one flow aperture for accessing the vial tube, said skirt including i) at least two non-adjacent vial retention flex members having vial retention flex member tips distal to said vial adapter top wall, each said vial retention flex member having an at least partially circumferentially extending inwardly protruding vial retention rib for snap fitting over the vial crown for vial retention purposes, and ii) at least two non-adjacent vial guidance flex members being at least as long as said at least two non-adjacent vial retention flex members and having vial guidance flex member tips distal to said vial adapter top wall, said at least two non-adjacent vial guidance flex members each having a hinged zone located at a distance from said vial adapter top wall thereby dividing each said vial guidance flex member into an upper vial guidance flex member section proximal said vial adapter top wall and a lower vial guidance flex member section distal said vial adapter top wall, said at least two non-adjacent vial guidance flex members each being outwardly radially hinged at its respective hinged zone relative to the longitudinal vial adapter centerline as a result of its respective vial guidance flex member tip contacting the vial shoulder upon telescopic snap fitting of said vial adapter on the injection vial; and (b) at least one fluid transfer port in flow communication with said puncturing cannula.

2. The device according to claim 1, wherein said at least two non-adjacent vial retention flex members each has a hinged zone which is further displaced from said vial adapter top wall than its respective at least partially circumferentially extending inwardly protruding vial retention rib, such that each said vial retention flex member is outwardly radially hinged at its respective hinged zone relative to the longitudinal vial adapter centerline, as a result of its respective vial retention flex member tip contacting the vial shoulder upon telescopic snap fitting of said vial adapter on the injection vial.

3. The device according to claim 1, wherein said at least two non-adjacent vial guidance flex member each having said hinged zone displaced at the same distance from said vial adapter top wall as said at least partially circumferentially extending inwardly protruding vial retention ribs such that, on telescopic snap fitting said vial adapter on the injection vial, said at least two upper vial guidance flex member sections and said at least two vial retention flex members snugly encircle the vial crown in a uniform manner for each vial tube outer diameter d1 from the predetermined range of at least one vial tube outer diameter d1.

4. The device according to claim 3 wherein each said vial guidance flex member subtends a sector angle of at least 90° around the longitudinal vial adapter centerline and includes a pair of spaced apart lower vial guidance flex member sections.

5. The device according to claim 1, wherein each hinged zone is constituted by an external peripheral groove.

6. The device according to claim 1, wherein each hinged zone is constituted by two or more spaced apart hinges.

* * * * *